US008240002B2

(12) United States Patent
Haan

(10) Patent No.: US 8,240,002 B2
(45) Date of Patent: Aug. 14, 2012

(54) BASE ASSEMBLY FOR VACUUM CLEANER

(75) Inventor: Gyung-Hee Haan, Seoul (KR)

(73) Assignee: HAAN Corporation, Seoul (KR)

( * ) Notice: Subject to any disclaimer, the term of this patent is extended or adjusted under 35 U.S.C. 154(b) by 636 days.

(21) Appl. No.: 12/459,119

(22) Filed: Jun. 25, 2009

(65) Prior Publication Data

US 2010/0037421 A1 Feb. 18, 2010

(30) Foreign Application Priority Data

Jun. 26, 2008 (KR) ..... 10-2008-0060918

(51) Int. Cl.
*A47L 5/10* (2006.01)

(52) U.S. Cl. ..... 15/387; 15/347

(58) Field of Classification Search ..... 15/327.7, 15/387, 347; *A47L 5/10*
See application file for complete search history.

(56) References Cited

U.S. PATENT DOCUMENTS

2009/0064447 A1* 3/2009 Oh et al. ..... 15/320
2009/0064448 A1* 3/2009 Oh et al. ..... 15/320
* cited by examiner

*Primary Examiner* — David Redding
(74) *Attorney, Agent, or Firm* — Zuber Lawler & Del Duca LLP

(57) ABSTRACT

Disclosed is a base assembly for a vacuum cleaner, which directly injects exhaust wind to the turbine wing one end of which is rotatably supported on the exhaust port of an intake motor in order to rotate the rotating brush to avoid the loss in the exhaust wind and to therefore obtain a high level of suction force with a small-size motor.

6 Claims, 29 Drawing Sheets

BASE ASSEMBLY FOR VACUUM CLEANER

CROSS REFERENCE TO RELATED APPLICATIONS

Not applicable.

STATEMENT REGARDING FEDERALLY-SPONSORED RESEARCH OR DEVELOPMENT

Not applicable.

REFERENCE TO SEQUENCE LISTING, A TABLE, OR A COMPUTER PROGRAM LISTING COMPACT DISK APPENDIX

Not applicable.

BACKGROUND OF THE INVENTION

The present invention relates to a base assembly for a vacuum cleaner. Specifically, the present invention relates to a vacuum cleaner base assembly which directly injects exhaust wind to the turbine wing one end of which is rotatably supported on the exhaust port of an intake motor in order to rotate the rotating brush to avoid the loss in the exhaust wind and to therefore obtain a high level of suction force with a small-size motor.

Conventional methods to rotate the rotating brush include (1) dust suction and rotating the rotating brush by means of one single motor, (2) allowing the turbine wing to rotate by dust suction air to rotate the rotating brush, (3) using two motors, that is, one for rotating the rotating brush and the other for suction, and (4) detouring the exhaust wind coming out of the suction motor to have the turbine wing rotate and to further rotate the rotating brush.

The method (1) is advantageous in terms of superior transmission of force as the belt is connected to the motor shaft and to the rotating brush, but there are drawbacks that power consumption is proportionally high depending on the rotation of the motor shaft, resulting in the large capacity motor or relatively weak rotating brush or suction force.

The method (2) is advantageous in that intake air rotates the turbine wing, as a result of which the less load acts upon the motor. However, there is much loss at the suction force which makes it difficult to suck coarse dust.

The method (3) ensures that suction and the rotation of the rotating brush are carried out according to the standard capacity, but it yields other troubles such as noise, unit price, complicated structure, etc.

The method (4) utilizes exhaust air from the intake motor to rotate the rotating brush, as a result of which the suction force can be increased without any loss in the motor. For instance, it is possible to get 1000 W out of 700 W motor (300 W comes from the rotating brush). However, an induction line is required to induce exhaust wind to the turbine wing, and a sufficient torque is hard to obtain because some of the exhaust wind gets lost en route to the turbine wing from the exhaust port.

BRIEF SUMMARY OF THE INVENTION

To solve the foregoing problems, the present invention is directed to a base assembly for vacuum cleaner which directly injects exhaust wind from the intake motor to the turbine wing to eliminate practically any loss in the exhaust wind and to therefore obtain a high level of suction force with a small-size motor.

To achieve the object described above, there is provided a base assembly for vacuum assembly as set forth in claim 1 of the invention, which comprises: a dust collector provided with an inlet and an outlet; an intake motor assembly provided with an intake port and an exhaust port that are connected to the outlet; a main body comprising an upper casing provided with a dust collector mounting groove for the dust collector and a motor mounting groove for the intake motor assembly, and a lower casing provided with a suction nozzle facing a bottom; a rotating brush arranged over the suction nozzle and installed rotatably at the main body; a turbine wing that rotates by wind exhausting through the exhaust port; and a rotation power transmit member for transmitting rotating force of the turbine wing to the rotating brush.

This construction makes it possible to inject exhaust wind from the intake motor directly to the turbine wing such that practically any loss in the exhaust wind is eliminated, giving rise to a high level of suction force with a small-size motor.

In the base assembly for vacuum cleaner as set forth in claim 2 of the invention, the intake motor assembly comprises: a wet type motor having a motor drive section and an impeller that receives power of the motor drive section in a shaft direction being transmitted and discharges it in a circumferential direction; an impeller casing having the intake port and the exhaust port; and an exhaust wind controller for controlling wind that exhausts through the exhaust port.

According to the construction of the exhaust wind controller, depending on the type of carpet to be cleaned, if the rotating brush has hard bristles, its rotational speed can be controlled to about 2000 rpm; if the rotating brush has soft and flexible bristles, its rotational speed can be controlled to about 300-500 rpm.

In the base assembly for vacuum cleaner as set forth in claim 3 of the invention, preferably one end of the turbine wing is rotatably supported on the exhaust port, and the other end is supported on the rotation power transmit member.

This construction makes it possible to do direct injection while allowing the exhaust port to support one end of the turbine wing, as a result of which the loss can be avoided with certainty.

In the base assembly for vacuum cleaner as set forth in claim 4 of the invention, the rotation power transmit member comprises a drive shaft that receives rotating force from the other end of the turbine wing, and a belt that transmits the torque of the drive shaft to the rotating brush, one end of the drive shaft supporting the other end of the turbine wing, the other end of the drive shaft being supported by a mounting portion which preferably comprises a shaft support mount portion for supporting the rotation of the other end of the drive shaft, and a fixing mount portion for fixing the shaft support mount portion to the upper casing.

In the base assembly for vacuum cleaner as set forth in claim 5 of the invention, the shaft support mount portion comprises first and second bearings for supporting the other end of the drive shaft, and a bearing support bracket fixed to the fixing mount portion while supporting the first and second bearings, wherein the bearing support bracket preferably includes a first leg plate and a second leg plate having a first paddle wheel support ball and a second paddle wheel support formed thereon to support the first bearing and the second bearing, respectively, and a connecting plate which connects the first leg plate and the second leg plate in a way that an opening is formed between them and which is fixed to the fixing mount portion.

With the bearing support bracket, the other end of the drive shaft can get a 2-point support within a narrow space to create torque in a stable manner.

In the base assembly for vacuum cleaner as set forth in claim 6 of the invention, the connecting plate is preferably provided with a spacer that is arranged between the first bearing and the second bearing.

With this construction, the first bearing and the second bearing are restricted to move towards each other, making it possible to obtain stable torque.

As evident from the above description, the base assembly for vacuum cleaner according to the present invention has at least the following benefits:

By directly injecting exhaust wind from the intake motor to the turbine wing, the loss in the exhaust wind can be avoided almost fully, as a result of which the suction force can be increased with a small-sized motor;

By controlling wind that exhausts through the exhaust port, depending on the type of carpet to be cleaned, if the rotating brush has hard bristles its rotational speed can be controlled to about 2000 rpm, and if the rotating brush has soft and flexible bristles its rotational speed can be controlled to about 300-500 rpm;

Since direct injection is possible while allowing the exhaust port to support one end of the turbine wing, the loss can be avoided with certainty under the compact construction;

In the presence of the bearing support bracket, the other end of the drive shaft can get a 2-point support within a narrow space to create torque in a stable manner; and In the presence of the spacer, the first bearing and the second bearing are restricted to movement towards each other, making it possible to obtain stable torque.

Other embodiments, features and advantages of the present invention will become more apparent from the following description of the embodiments, taken together with the accompanying several views of the drawings, which illustrate, by way of example, the principles of the present invention.

BRIEF DESCRIPTION OF THE SEVERAL VIEWS OF THE DRAWINGS

The above and other objects and features of the present invention will become apparent from the following description of preferred embodiments, given in conjunction with the accompanying drawings, in which.

DETAILED DESCRIPTION OF THE INVENTION

In the following description of the present invention reference is made to the accompanying drawings which form a part thereof, and in which is shown, by way of illustration, exemplary embodiments illustrating the principles of the present invention and how it may be practiced. It is to be understood that other embodiments may be utilized to practice the present invention and structural and functional changes may be made thereto without departing from the scope of the present invention.

Hereinafter, a preferred embodiment of the present invention will be described in detail with reference to the accompanying drawings. Since the cleaner of this embodiment can be embodied as a vacuum cleaner or a steam vacuum cleaner, the term 'vacuum cleaner' and the term 'steam vacuum cleaner' will be interchangeably used depending on the structural addition. That is, the vacuum cleaner is designated to include a base assembly (vacuum cleaning section) and a stick assembly, and the steam vacuum cleaner is designated to include a base assembly (vacuum cleaning section), a main assembly (steam generating section plus stick), and a neck assembly. References on the main assembly and the neck assembly or the stick assembly can be made to prior art publications, so explanations of these will be omitted here.

Figure 1:
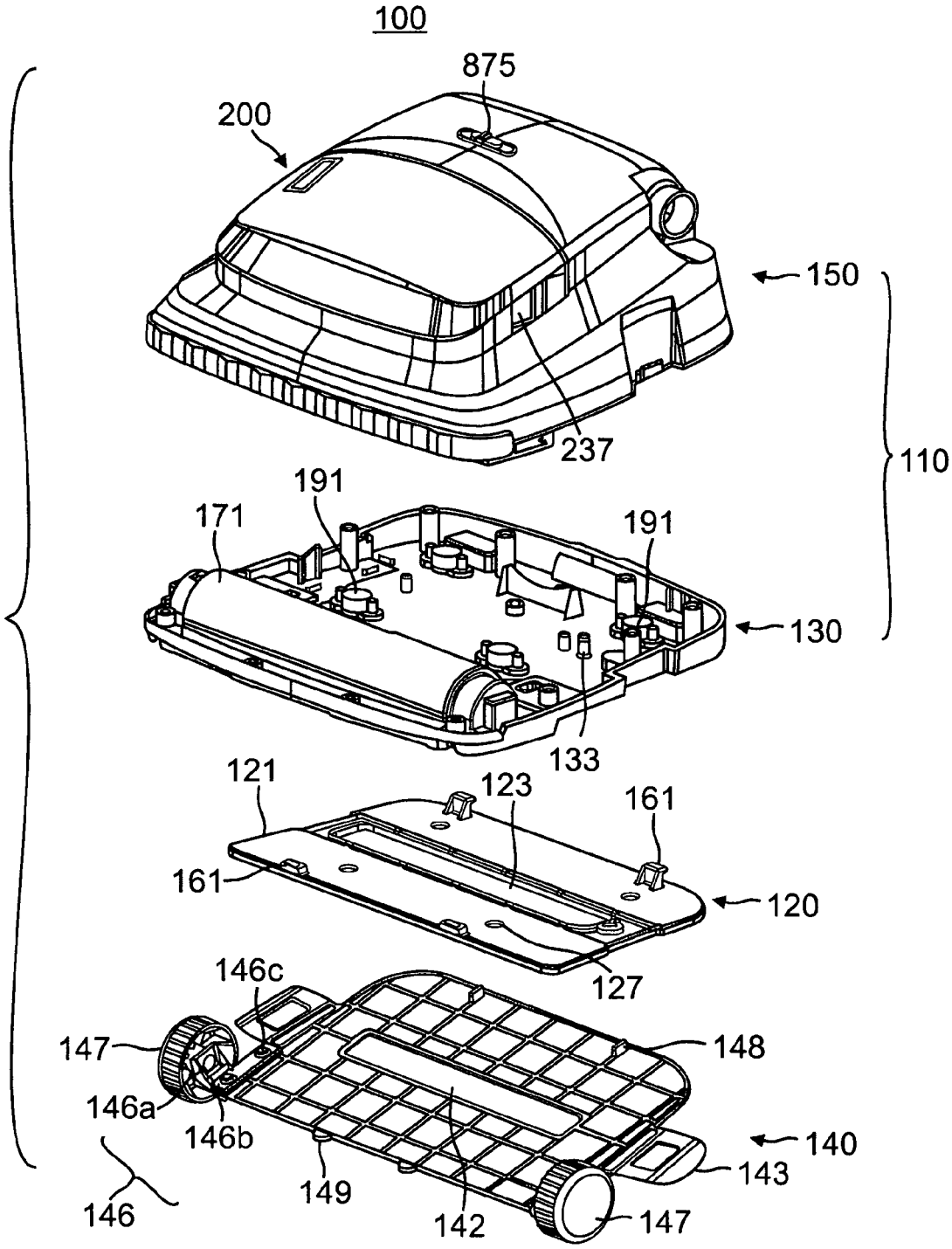
FIG. 1 is an exploded front perspective view of a base assembly for vacuum cleaner according to a preferred embodiment of the present invention.
Figure 2:
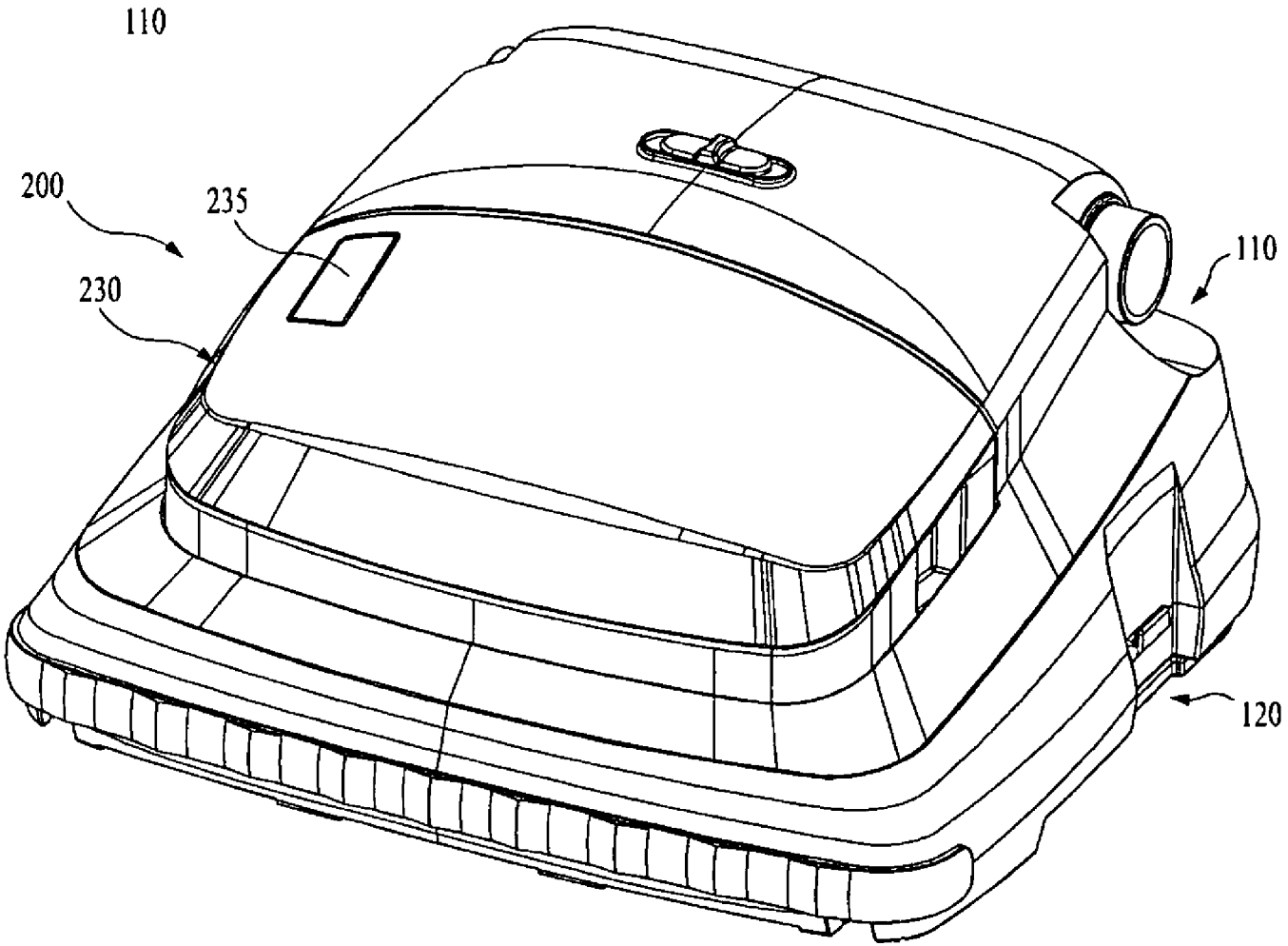
FIG. 2 is a front perspective view and a rear perspective view of the joined base assembly without a cover tray in FIG. 1.
Figure 3:
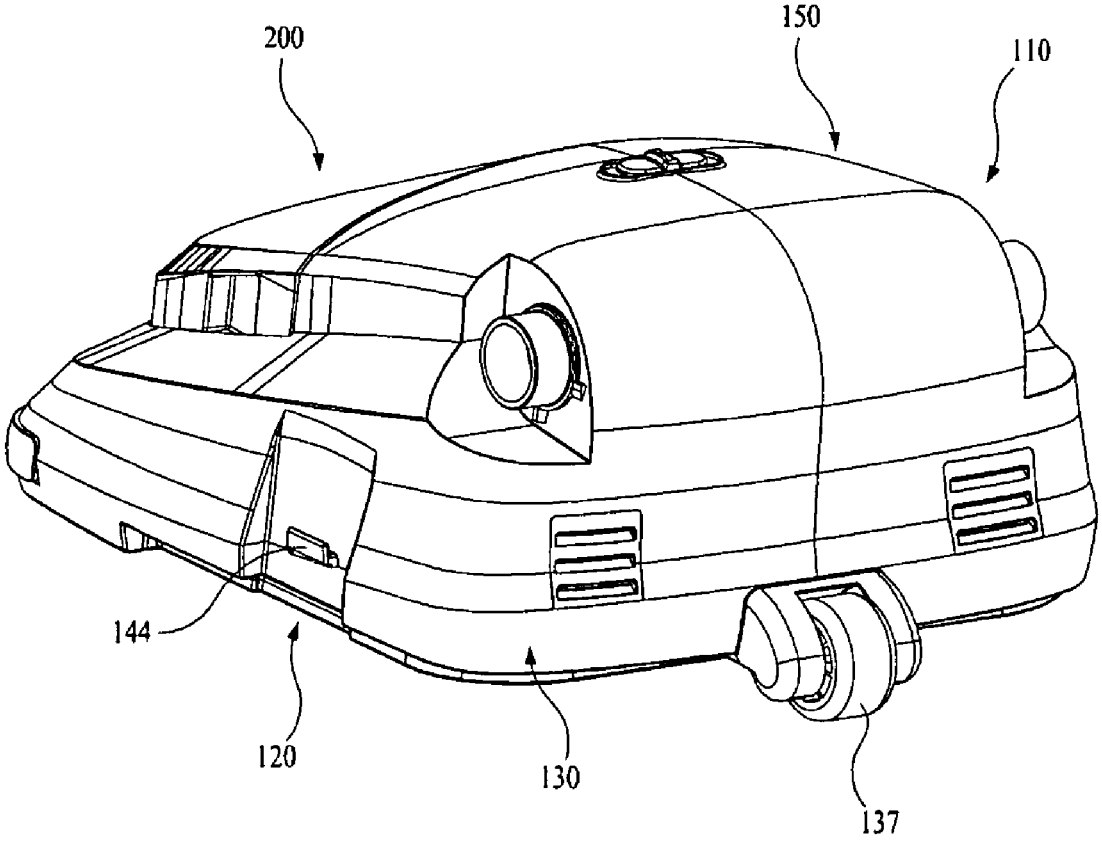
FIG. 3 is a front perspective view and a rear perspective view of the joined base assembly without a cover tray in FIG. 1.
Figure 4:
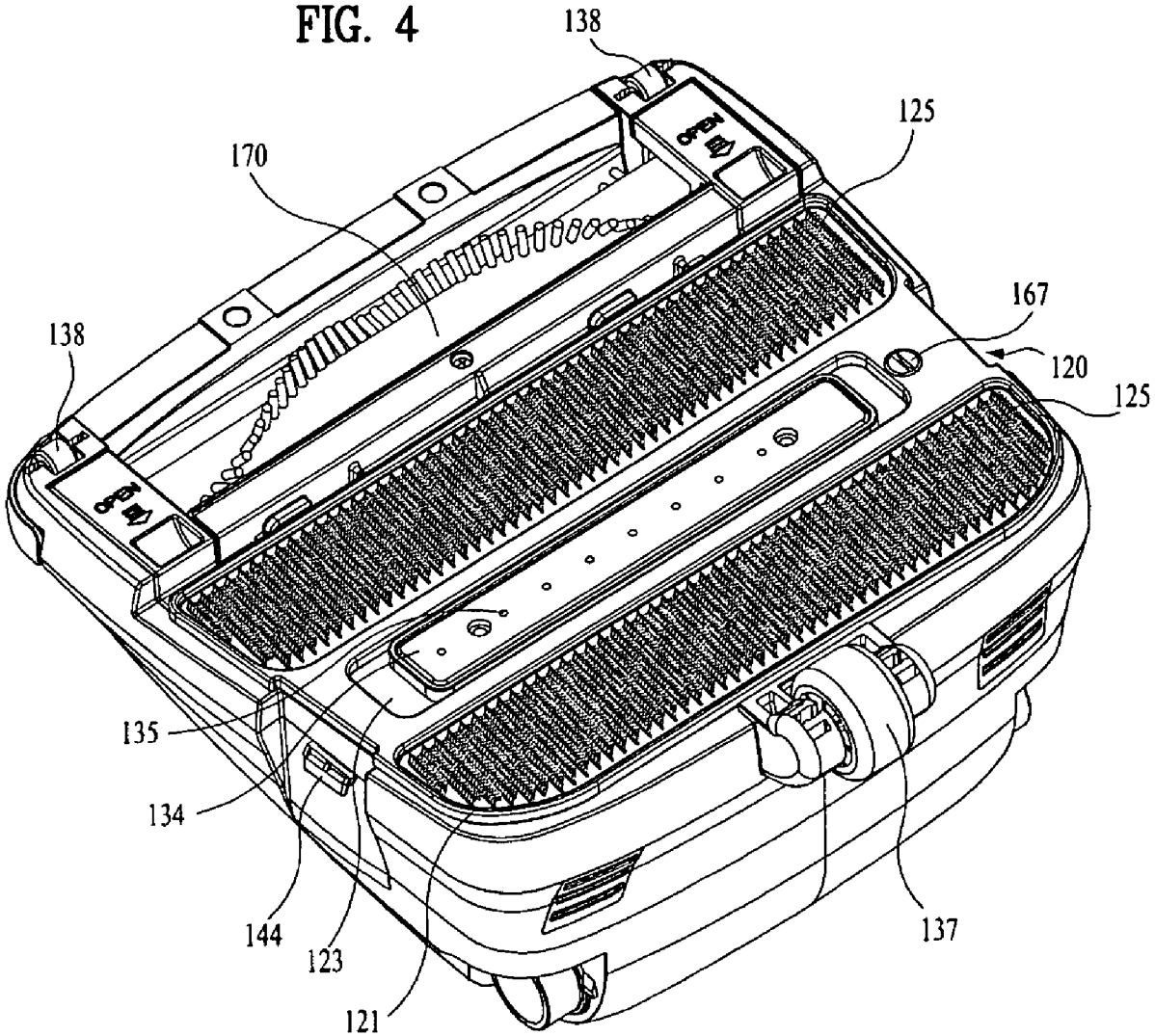
FIG. 4 is a bottom perspective view of FIG. 2 and of FIG. 3.

FIG. 1 is an exploded front perspective view of a base assembly for a vacuum cleaner according to a preferred embodiment of the present invention, FIG. 2 and FIG. 3 are a front perspective view and a rear perspective view respectively of the joined base assembly without a cover tray in FIG. 1, and FIG. 4 is a bottom perspective view of FIG. 2 and of FIG. 3.

As shown in FIG. 1 to FIG. 4, a base assembly 100 for a steam vacuum cleaner according to this embodiment includes a main body 110 constituted with a lower casing 130 and an upper casing 150, a vacuum cleaning section mounted at this main body 110, and a pad attachment tray 120 that is elevatably supported on the bottom surface of the lower casing 130.

Figure 8:
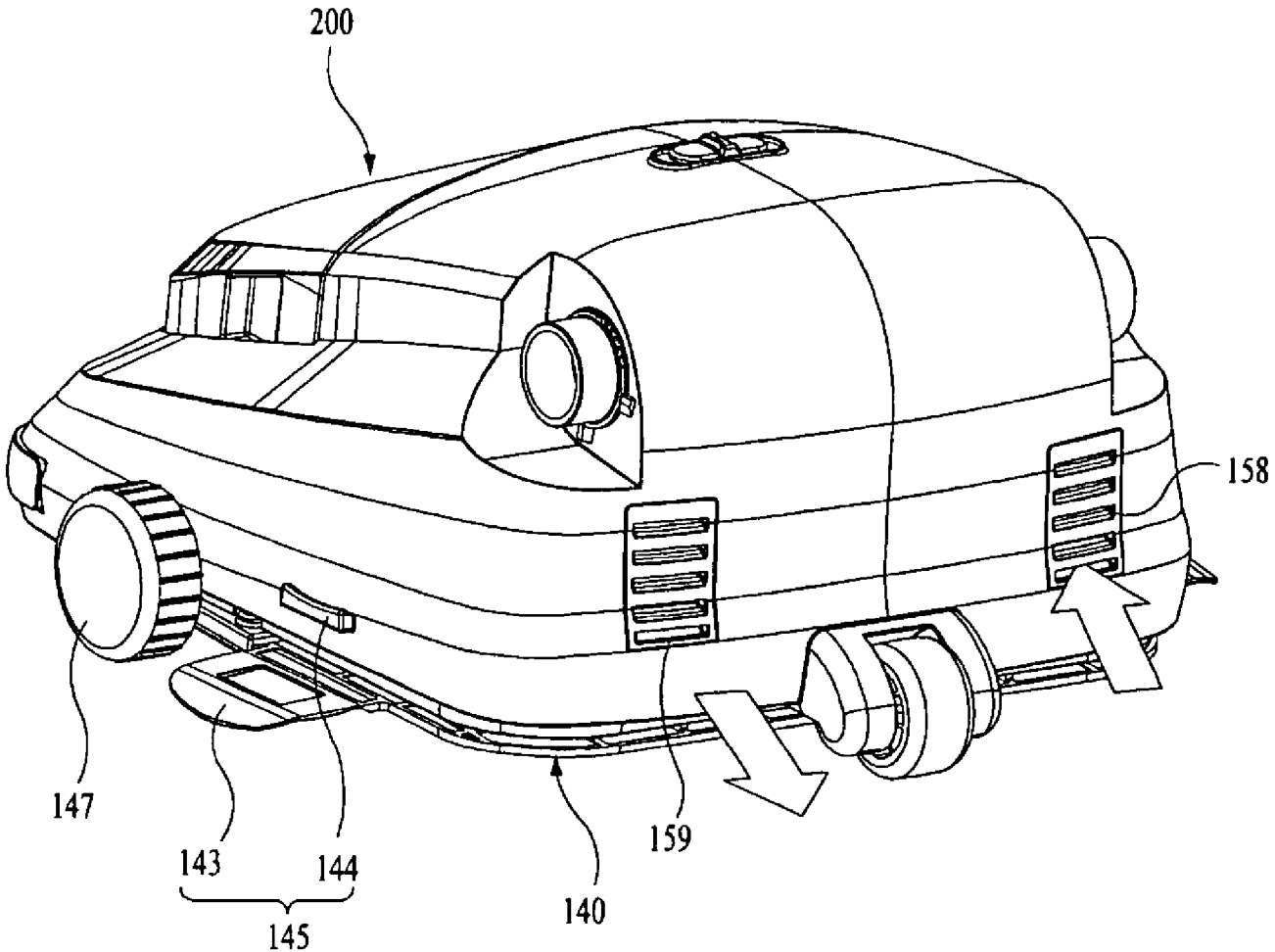
FIG. 8 is a joined rear perspective view of FIG. 1.
Figure 9:
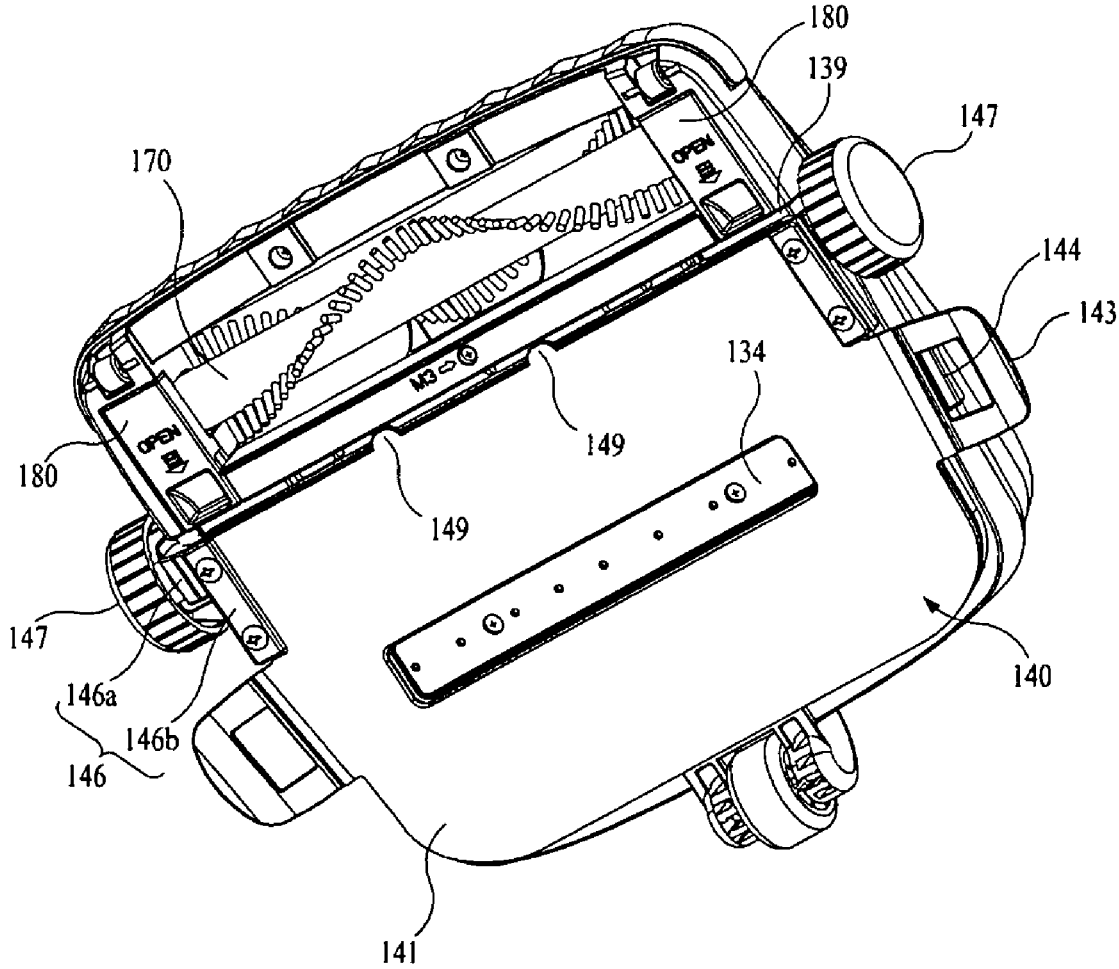
FIG. 9 is a bottom perspective view of FIG. 8.

The lower casing 130, as shown in FIG. 8, is provided with a suction nozzle 131 on the front side, and a steam ejecting hole 133 on the rear side. Steam coming out of the steam ejecting hole 133 is ejected over the pad (not shown) through a multiplicity of bores 135 formed in a steam distribution cover 134. The steam ejecting hole 133 is required, as disclosed in the publications of the prior art, when the main assembly connected to the steam generating section is used, and it may not be provided if the main assembly is primarily served as a stick.

A bumper made of elastic materials such as rubber or plastics is formed at the frame of the front side of the lower casing 130, so that the main body 110 can be protected as much as possible from damages such as getting broken or cracked when bumped into the wall while cleaning.

Figure 11:
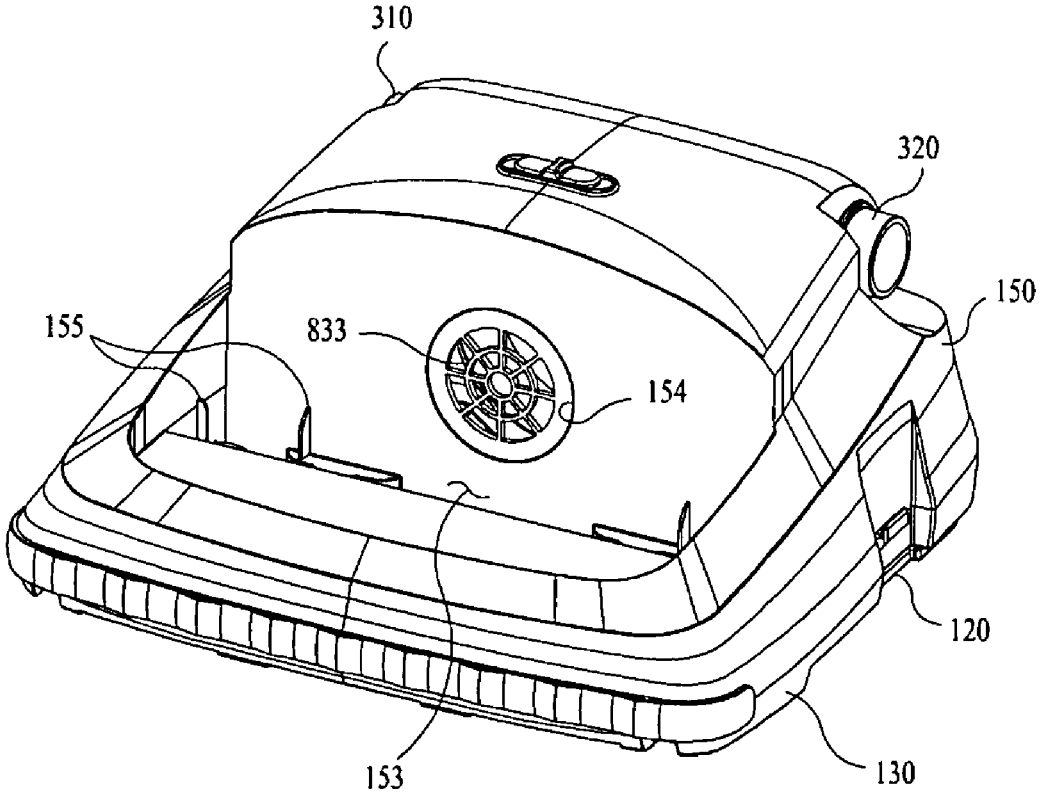
FIG. 11 is a front perspective view of FIG. 2 without a dust collector.
Figure 12:
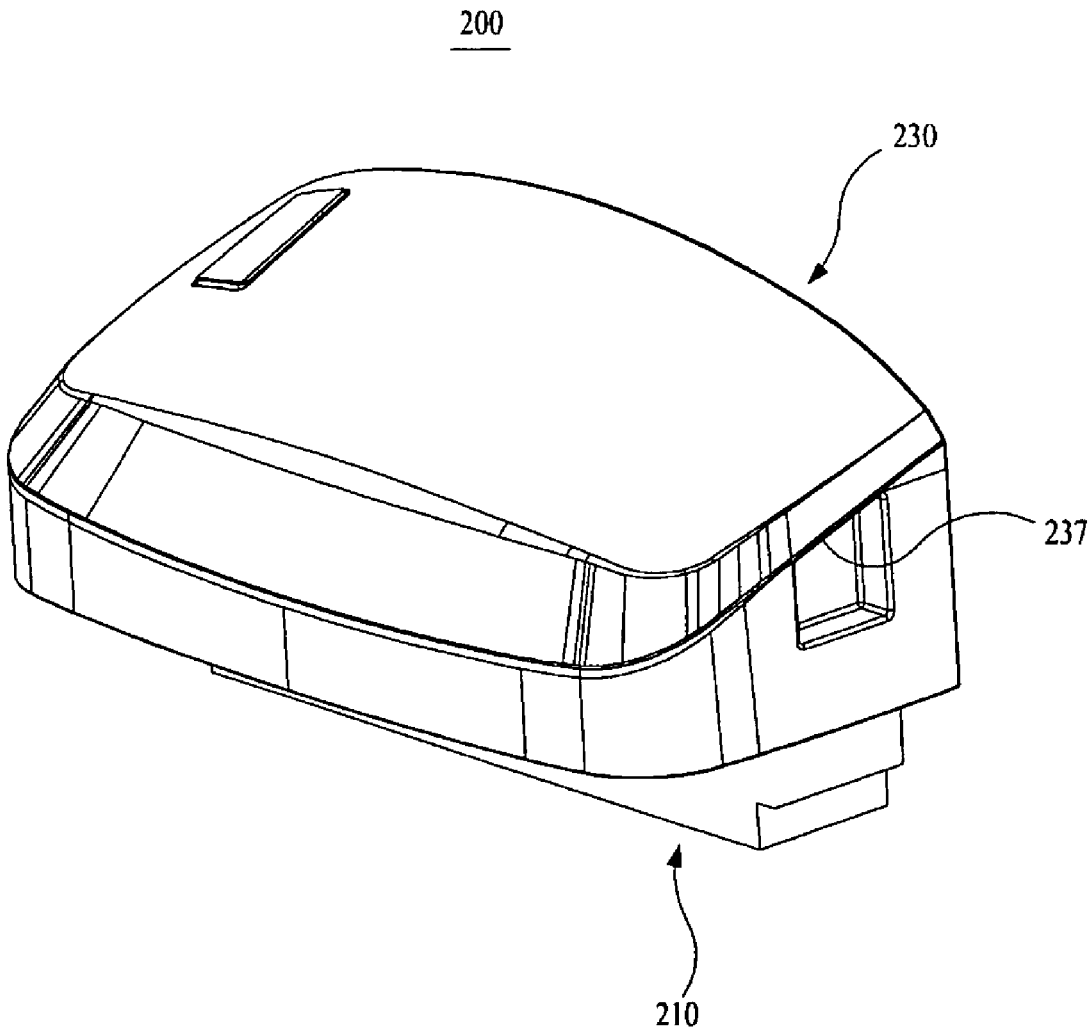
FIG. 12 is a front perspective view and a rear perspective view of the dust collector.
Figure 13:
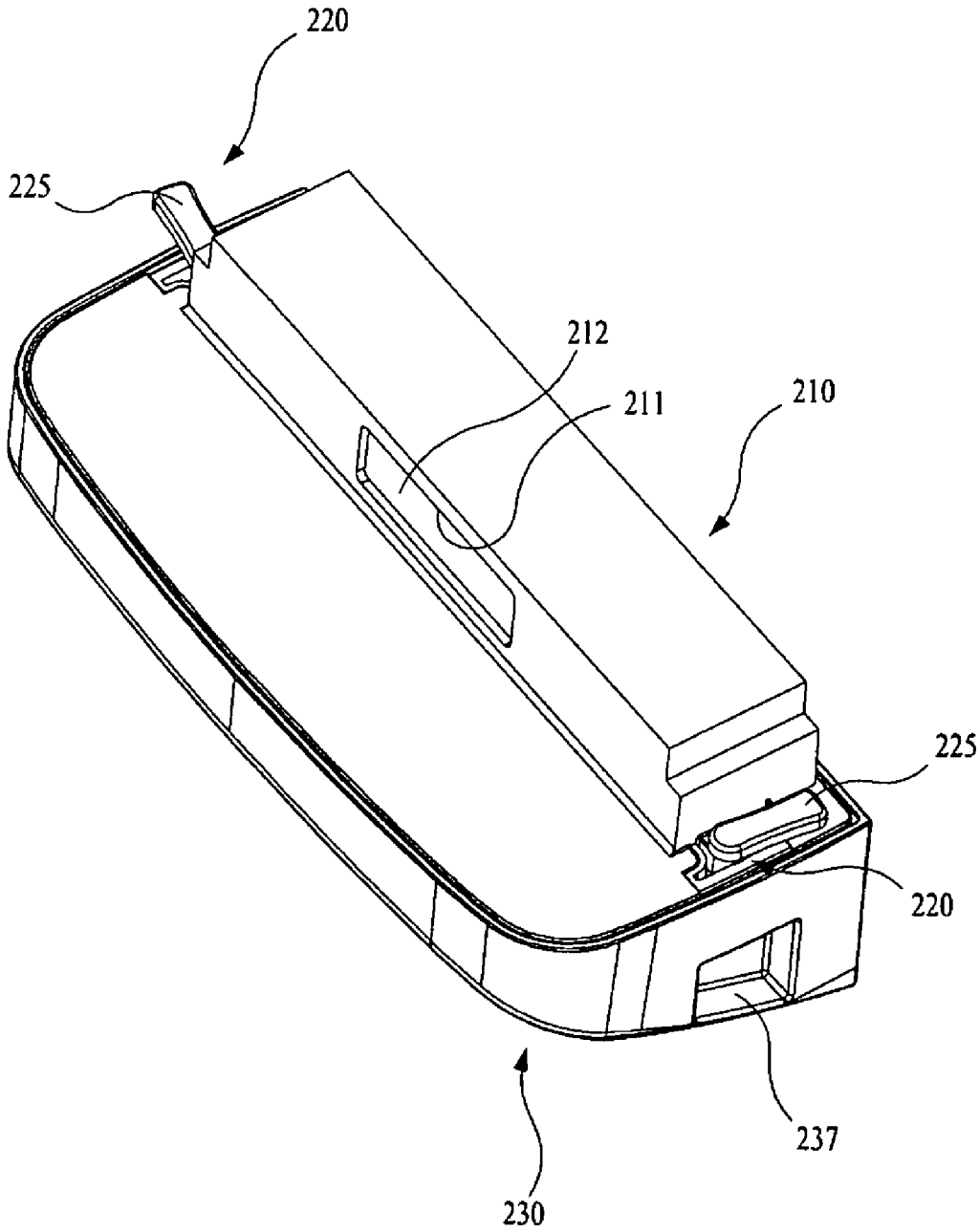
FIG. 13 is a front perspective view and a rear perspective view of the dust collector.
Figure 14:
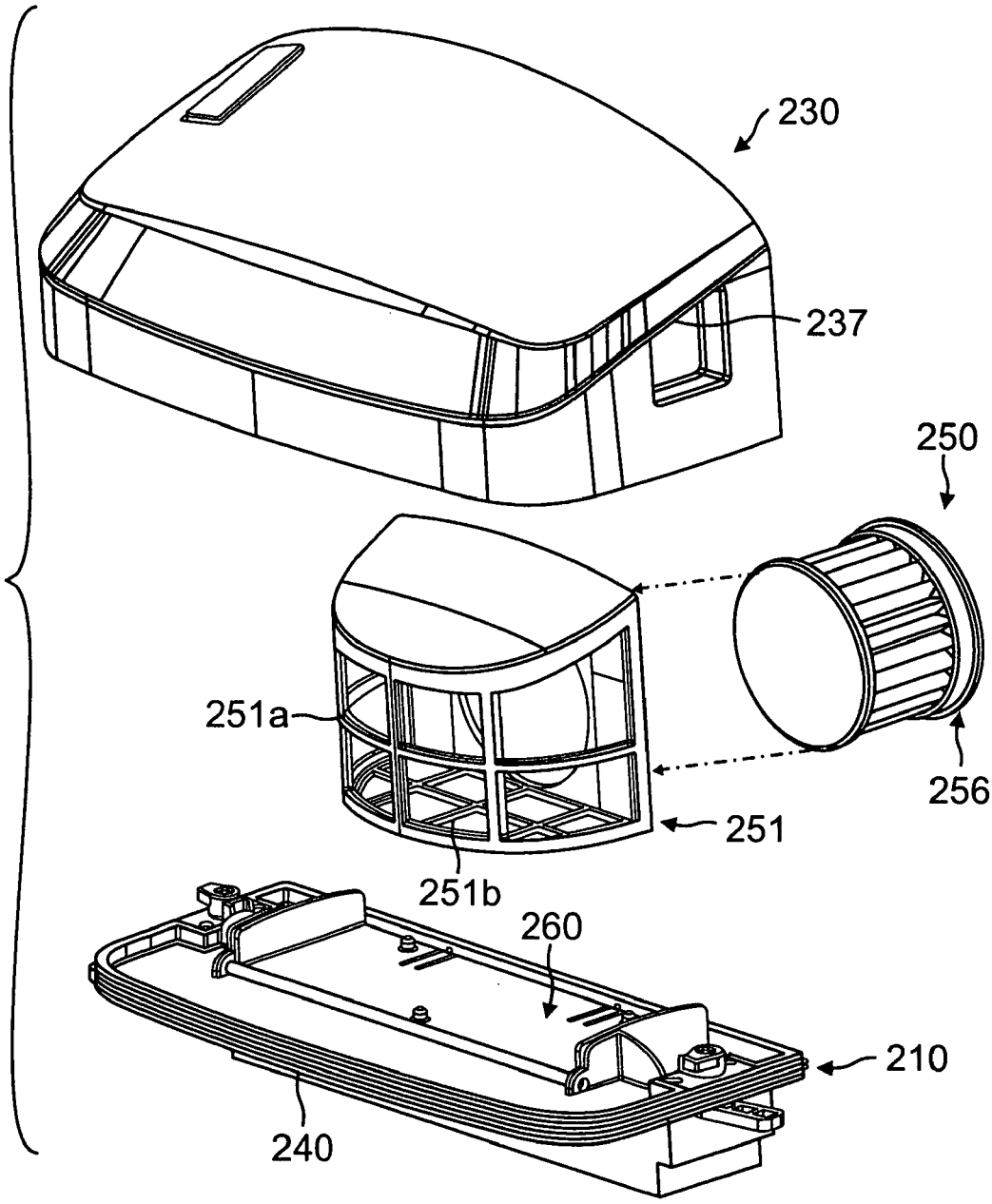
FIG. 14 is an exploded front perspective view and an exploded rear perspective view of the dust collector.
Figure 15:
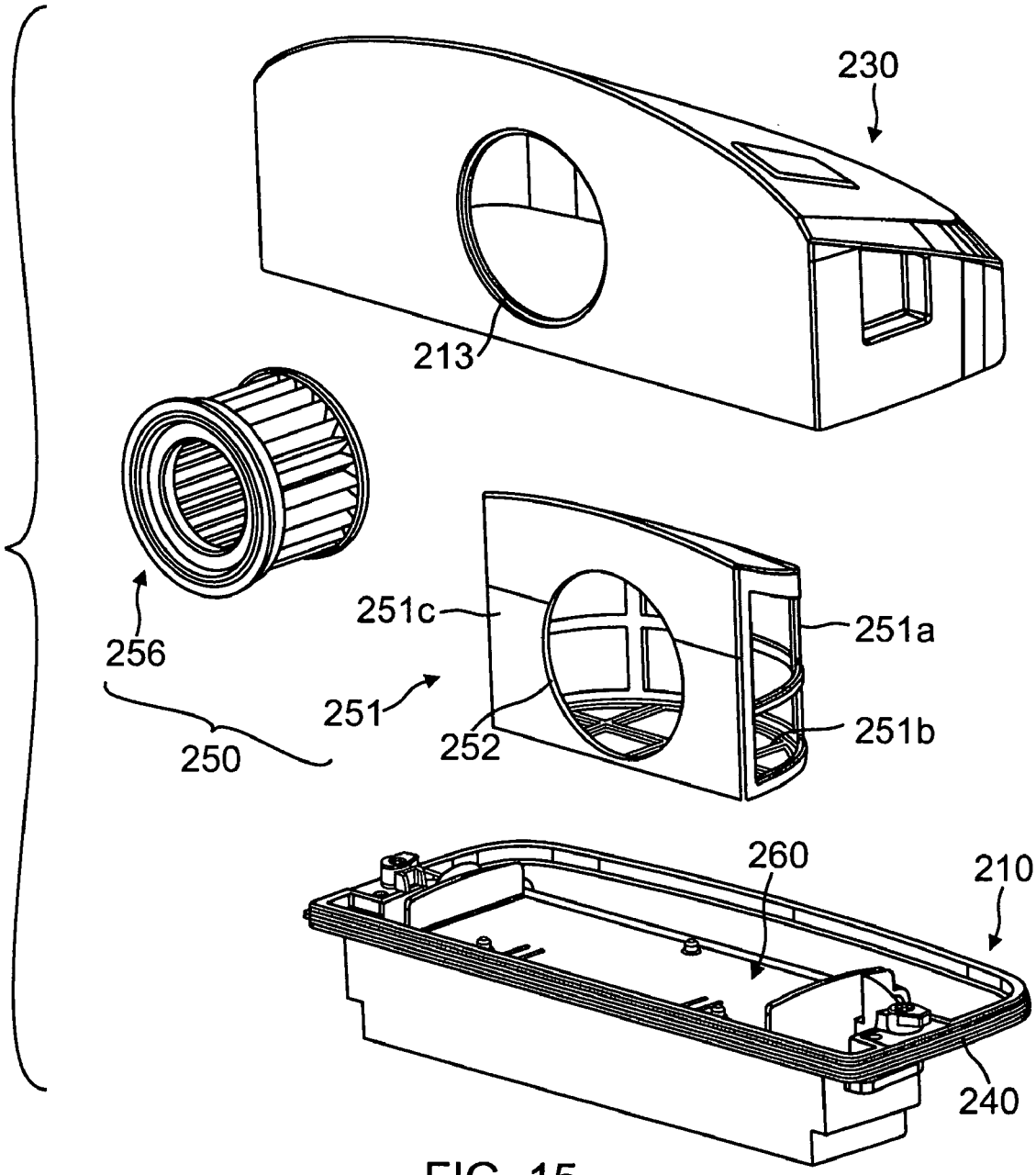
FIG. 15 is an exploded front perspective view and an exploded rear perspective view of the dust collector.
Figure 16:
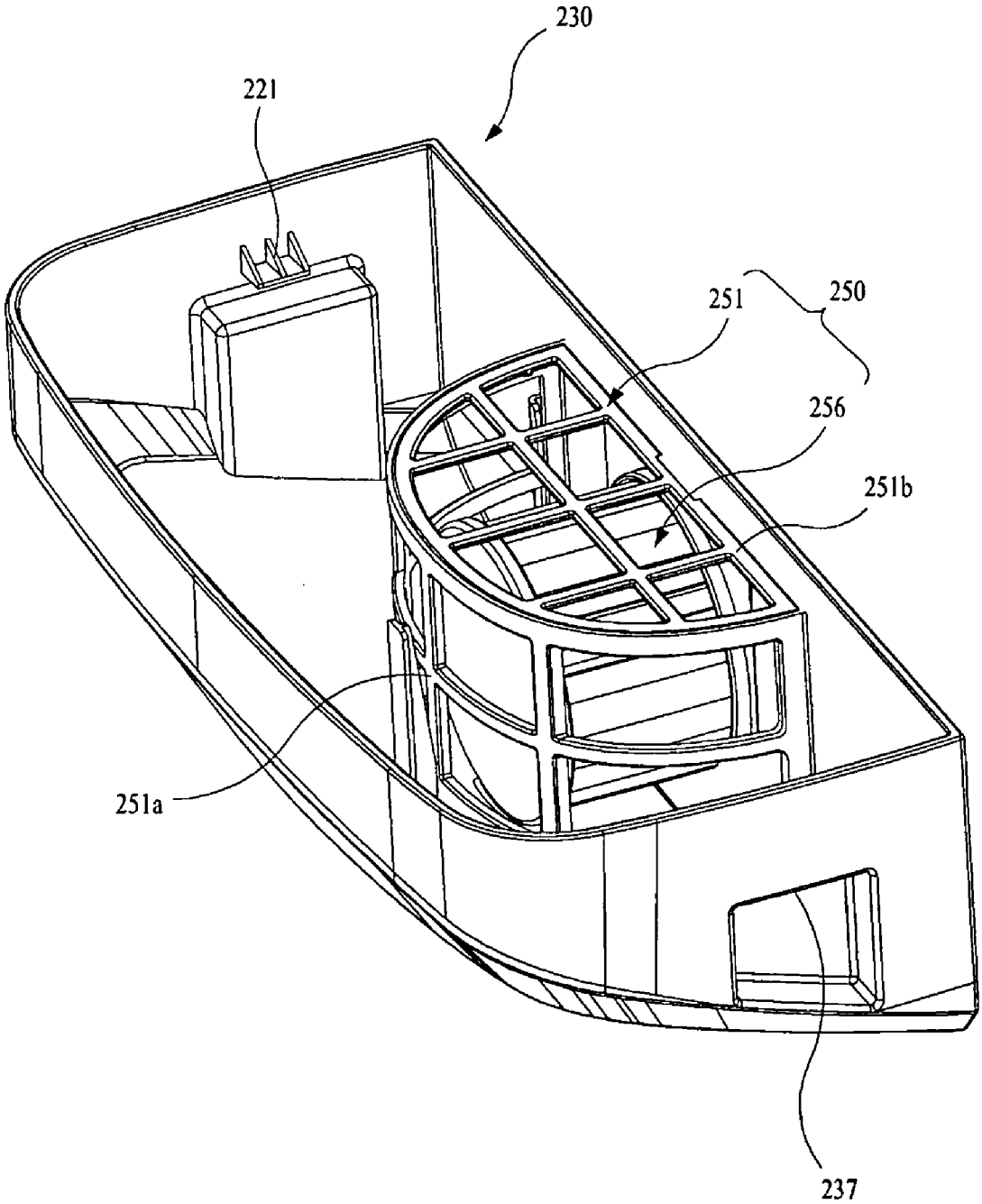
FIG. 16 is a bottom perspective view showing an upper dust bin joined with a filter.
Figure 20:
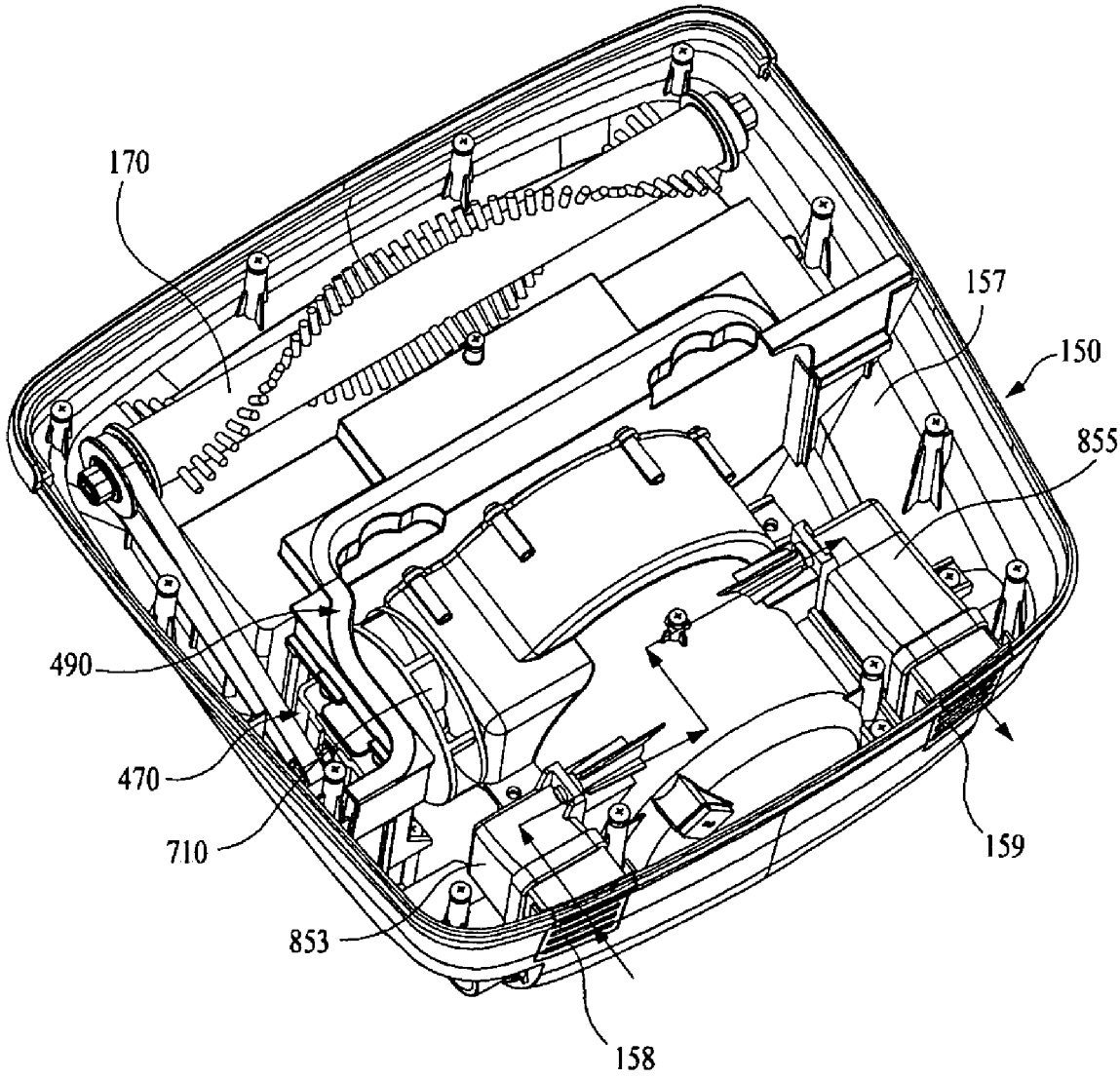
FIG. 20 is a bottom perspective views showing the main portion without a lower casing.
Figure 21:
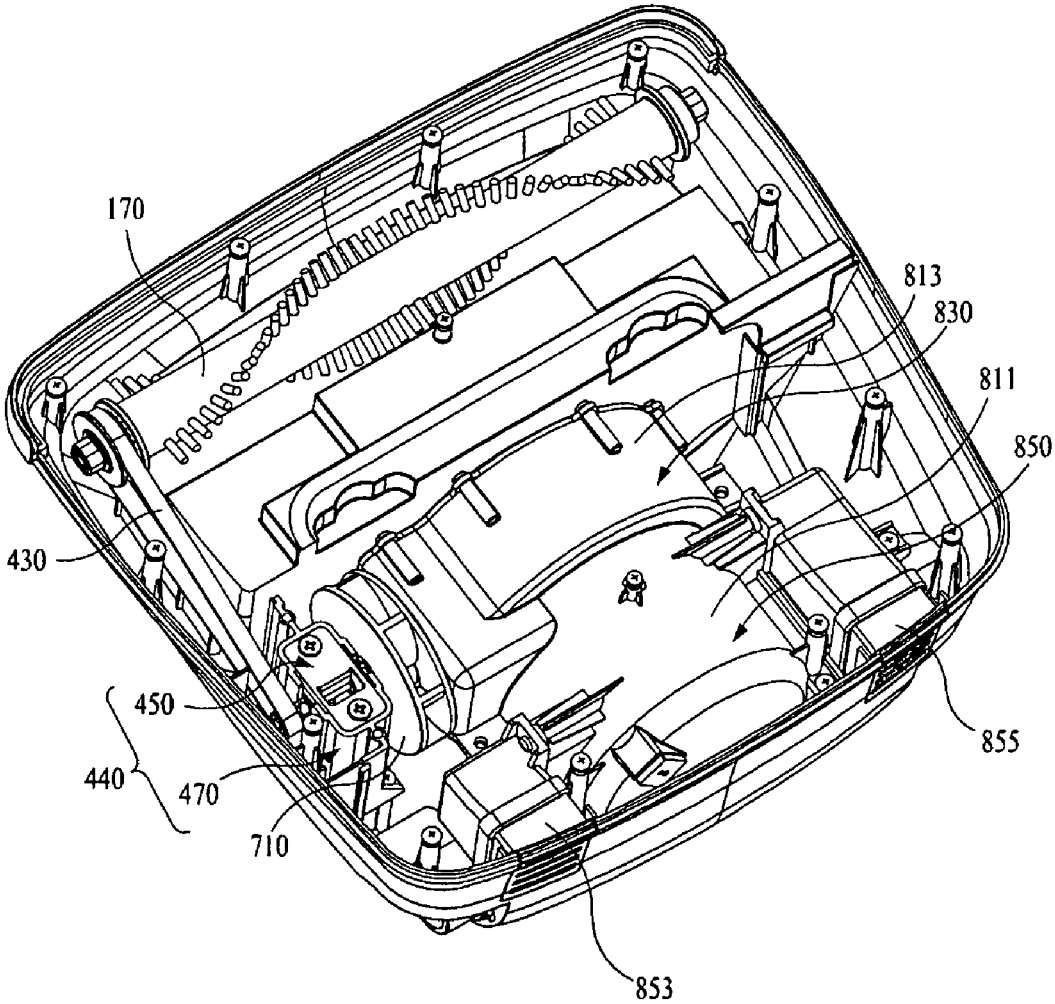
FIG. 21 is a bottom perspective views showing the main portion without a lower casing.
Figure 22:
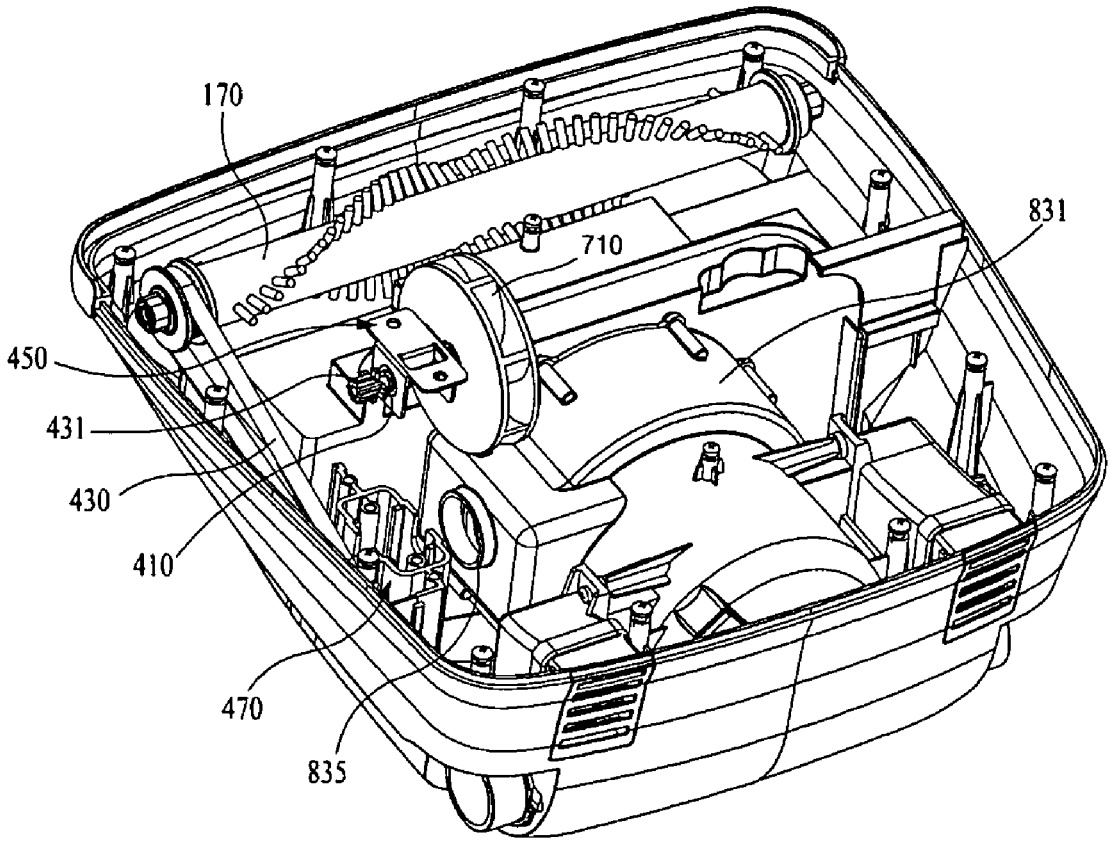
FIG. 22 is a bottom perspective views showing the main portion without a lower casing.
Figure 23:
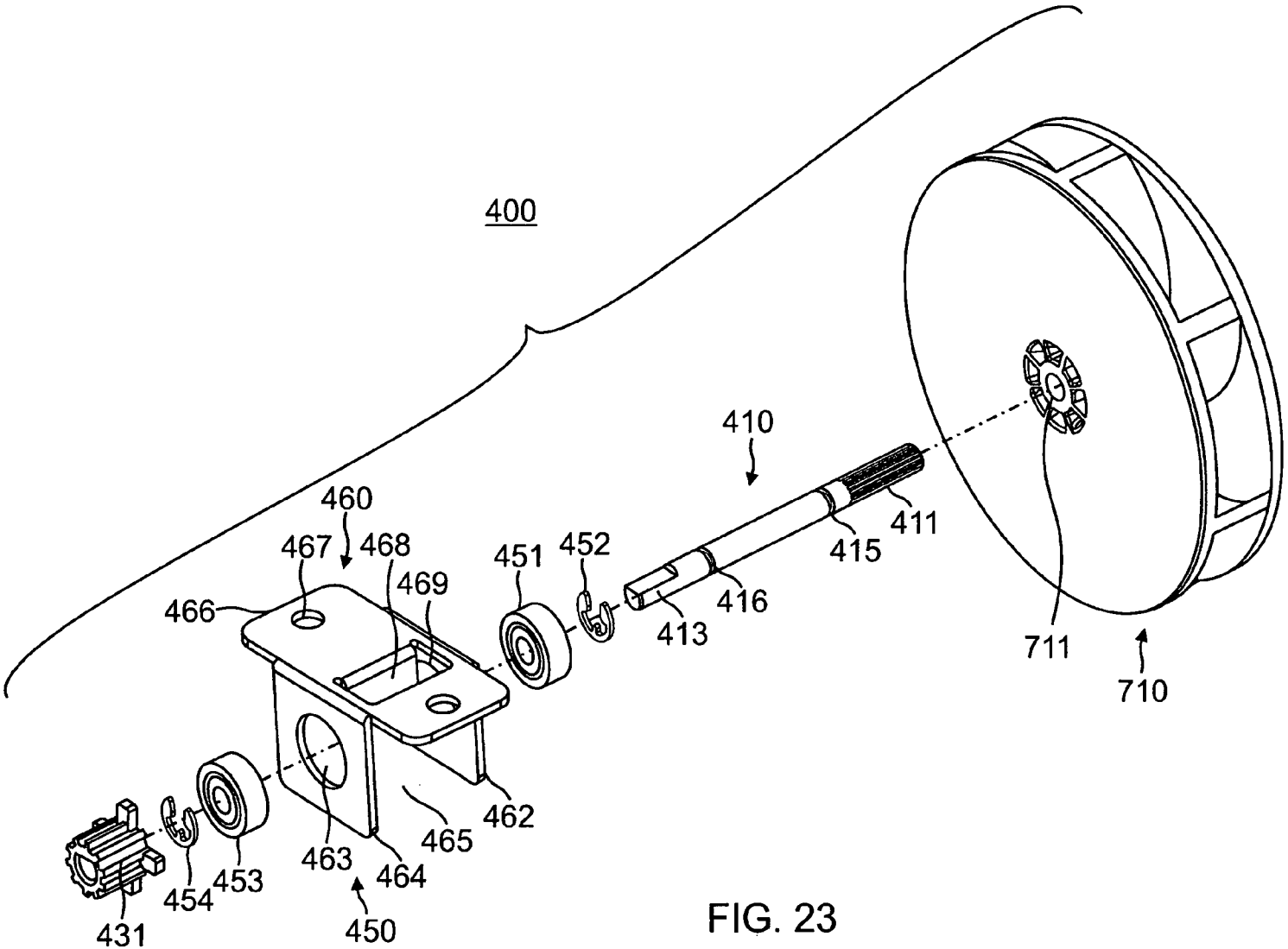
FIG. 23 is an exploded perspective view and an assembled perspective view of the rotation power transmit member of a rotating brush.
Figure 24:
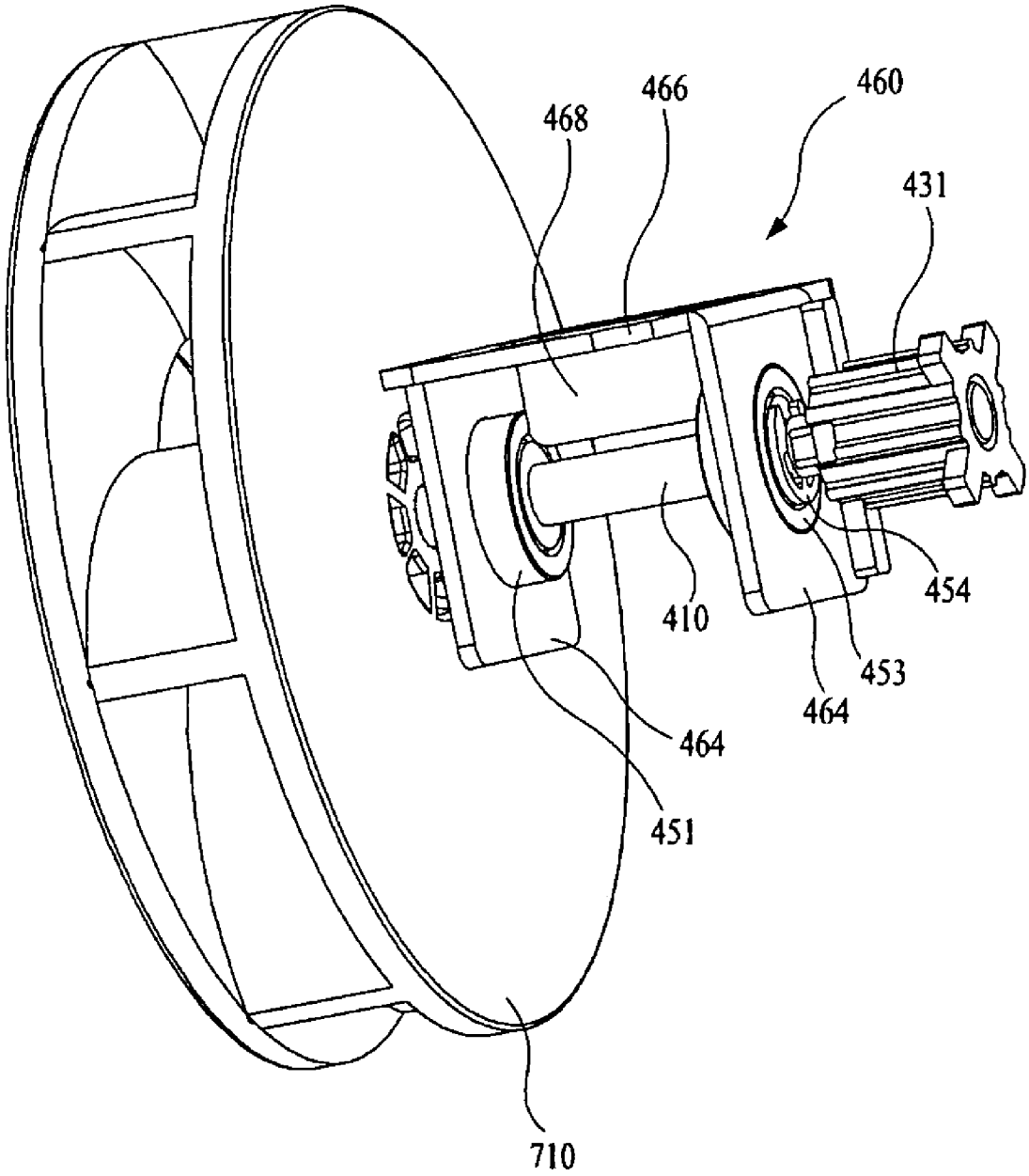
FIG. 24 is an exploded perspective view and an assembled perspective view of the rotation power transmit member of a rotating brush.
Figure 25:
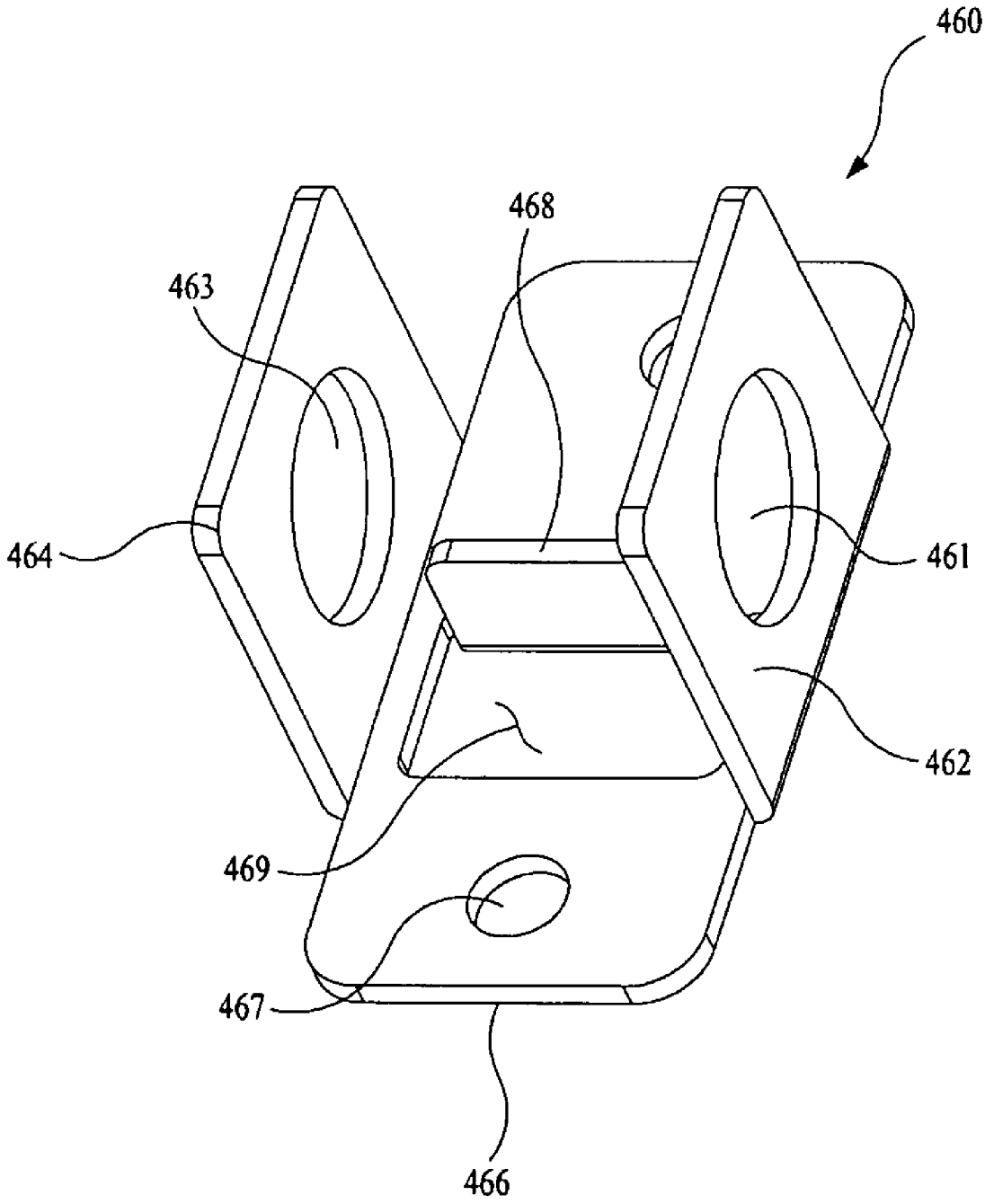
FIG. 25 is a bottom perspective view of a bearing support bracket.
Figure 26:
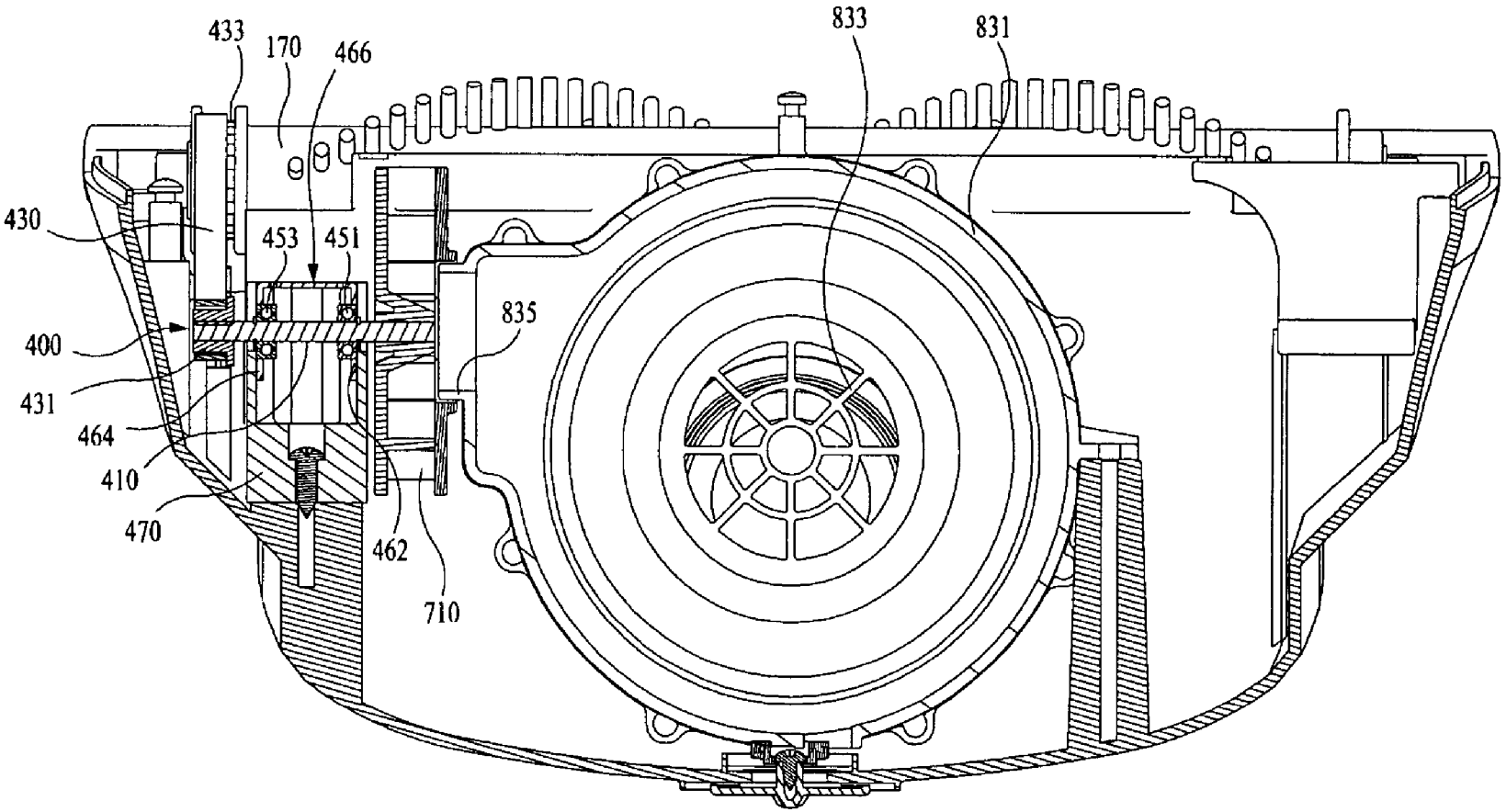
FIG. 26 is a horizontal sectional view of FIG. 21.
Figure 27:
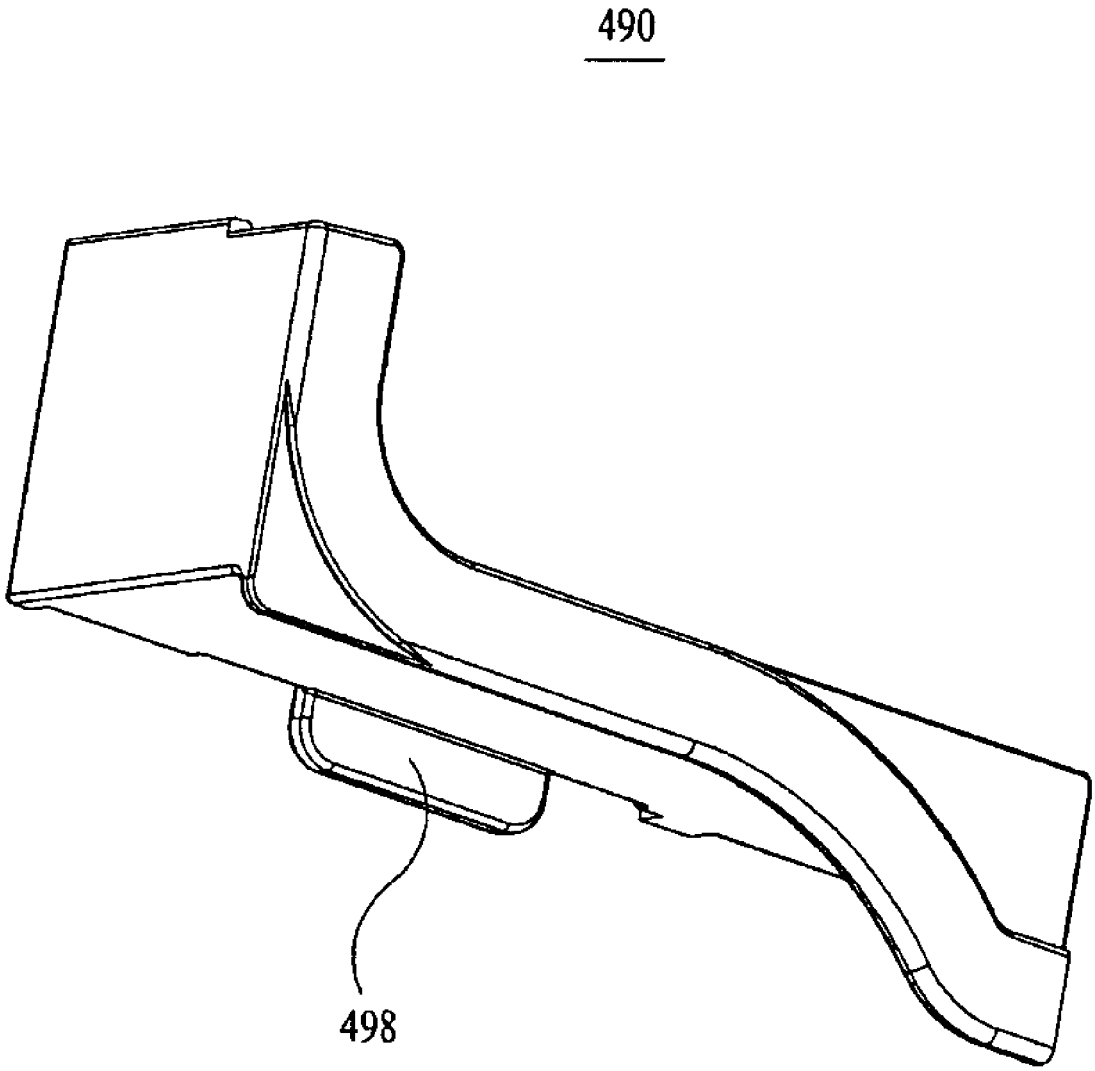
FIG. 27 is a top perspective view and a bottom perspective view of a blocking wall between the rotation force transmit member and the turbine wing.
Figure 28:
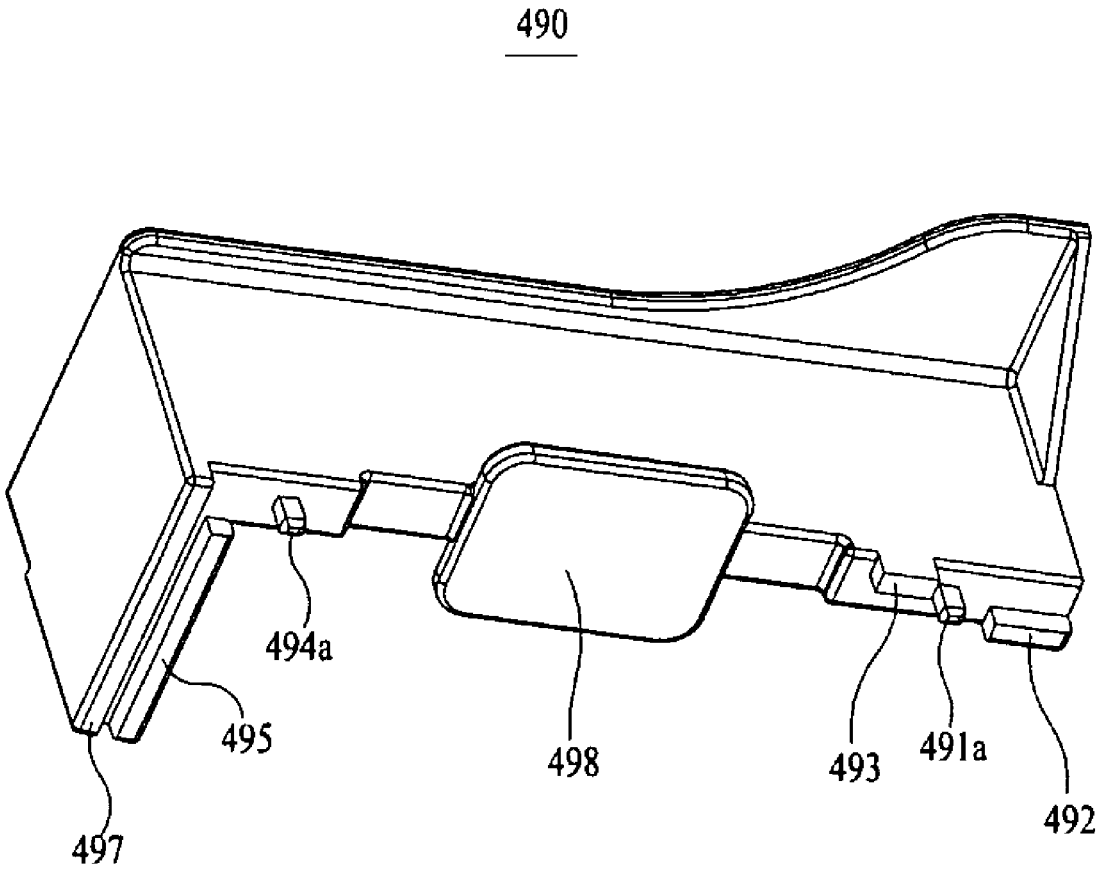
FIG. 28 is a top perspective view and a bottom perspective view of a blocking wall between the rotation force transmit member and the turbine wing.

On the front side of the top surface the upper casing 150 is a dust collector mounting groove 153 where a dust collector 200 is mounted (see FIG. 11), and on the rear side of the bottom surface of the upper casing 150 is an intake motor mounting groove 157 where an intake motor assembly 800 is mounted (see FIG. 20).

A suction bore 154 is formed in the front side wall of the dust collector mounting groove 153. This suction bore 154 allows the suction nozzle 131 and an intake port 211 of a lower dust collection bin 210 (to be described) to communicate with each other.

Figure 10:
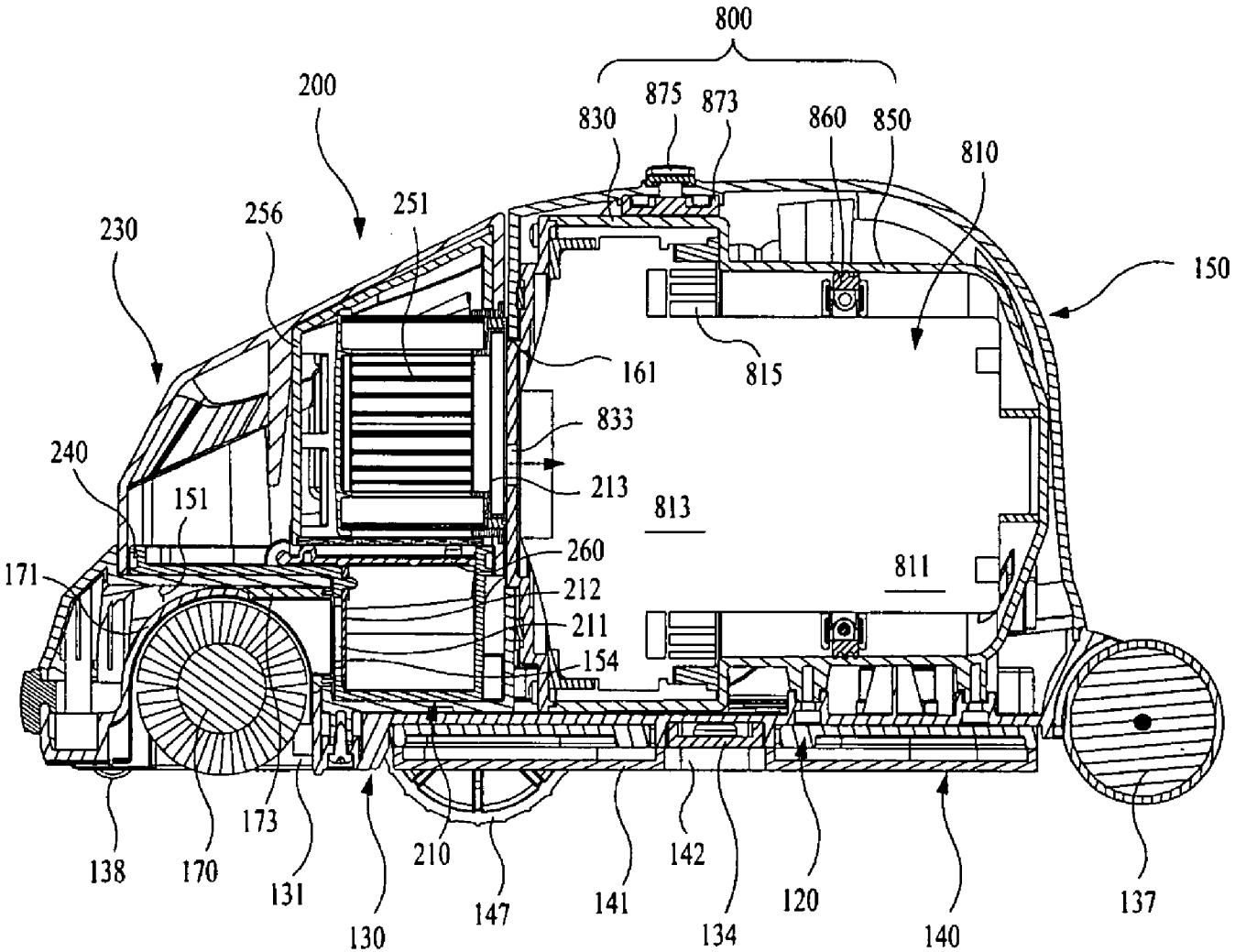
FIG. 10 is a vertical sectional view of FIG. 8.

As shown in FIG. 10, this suction bore 154 is connected to an intake duct 173. One end of the intake duct 173 fits into a rotating brush support bracket 171 which supports the rotation of the rotating brush 170, and the other end of the intake duct 173 fits into the suction bore 154.

The rotating brush support bracket 171 is locked and supported in a rotating brush mounting groove 151 that is formed in the bottom surface (lower surface) of the forefront side of the upper casing 150.

In the upper casing 150, the rotating brush mounting groove 151, the dust collector mounting groove 153, and the intake motor mounting groove 157 are formed in the front-to-back direction in the order mentioned here.

With this construction, when the rotating brush 170 rotates, it scratches dust on the floor, and the dust is sucked up through the suction nozzle 131 and gets into the intake port 211 via the intake duct 173 and the suction bore 154 until it is trapped in the dust collector 200.

In addition, a bore 154 is formed on the rear side wall of the dust collector mounting groove 153 or on the front side wall of the intake motor mounting groove 157.

This bore 154 allows an exhaust port 213 of the dust collector 200 and an intake port 833 of an impeller casing 830 of an intake motor 810 to communicate with each other.

A first vent hole 158 and a second vent hole 159 where a cool air inlet tube 853 and a hot air outlet tube 855 are disposed respectively are formed in the rear side wall of the intake motor mounting groove 157.

Preferably, a rib 155 is formed in the dust collector mounting groove 153. This rib 155 makes the lower dust collection bin 210 fit to a certain extent.

Furthermore, hollow hinges 310 and 320 are formed on both rear sides of the upper casing 150. The hinges 310 and 320 communicate with the motor mounting groove 157. Also, a neck assembly (not shown), as is in the prior art, is pivotably joined with the hinges 310 and 320.

Therefore, intake air coming out of the motor assembly 800 turns the turbine wing 710 and, as in the prior art, it goes through the hinges 310 and 320 and the neck casing of the neck assembly within the motor mounting groove 157 to be discharged to outside through the exhaust port of the main assembly.

The pad attachment tray 120 is disposed and installed at the bottom surface of the lower casing 130 through an elevation support member. Of course, an elevatable recess 139 is formed at the bottom surface of the lower casing 130. Preferably, this elevatable recess 139 has a depth equivalent to the protruded height of the steam distribution cover 134.

Accordingly, now that the pad attachment tray 120 is supported by the elevation support member to be elevatable, it is possible to prevent incapability of gathering dust stuck on the floor which occurs when the floor and the rotating brush 170 are too distant from each other as much as the thickness of the pad, thereby maintaining the cleaning efficiency of both steam and vacuum as it is.

The pad attachment tray 120 is constituted with a pad attachment plate 121, an withdrawal opening 123 formed in the pad attachment plate 121, and protrusions 125 formed at the front and rear side bottom surfaces of the withdrawal opening 123. The steam distribution duct 134 is withdrawn through this withdrawal opening 123, and a Velcro pad is attached to the protrusions 125.

Figure 6:
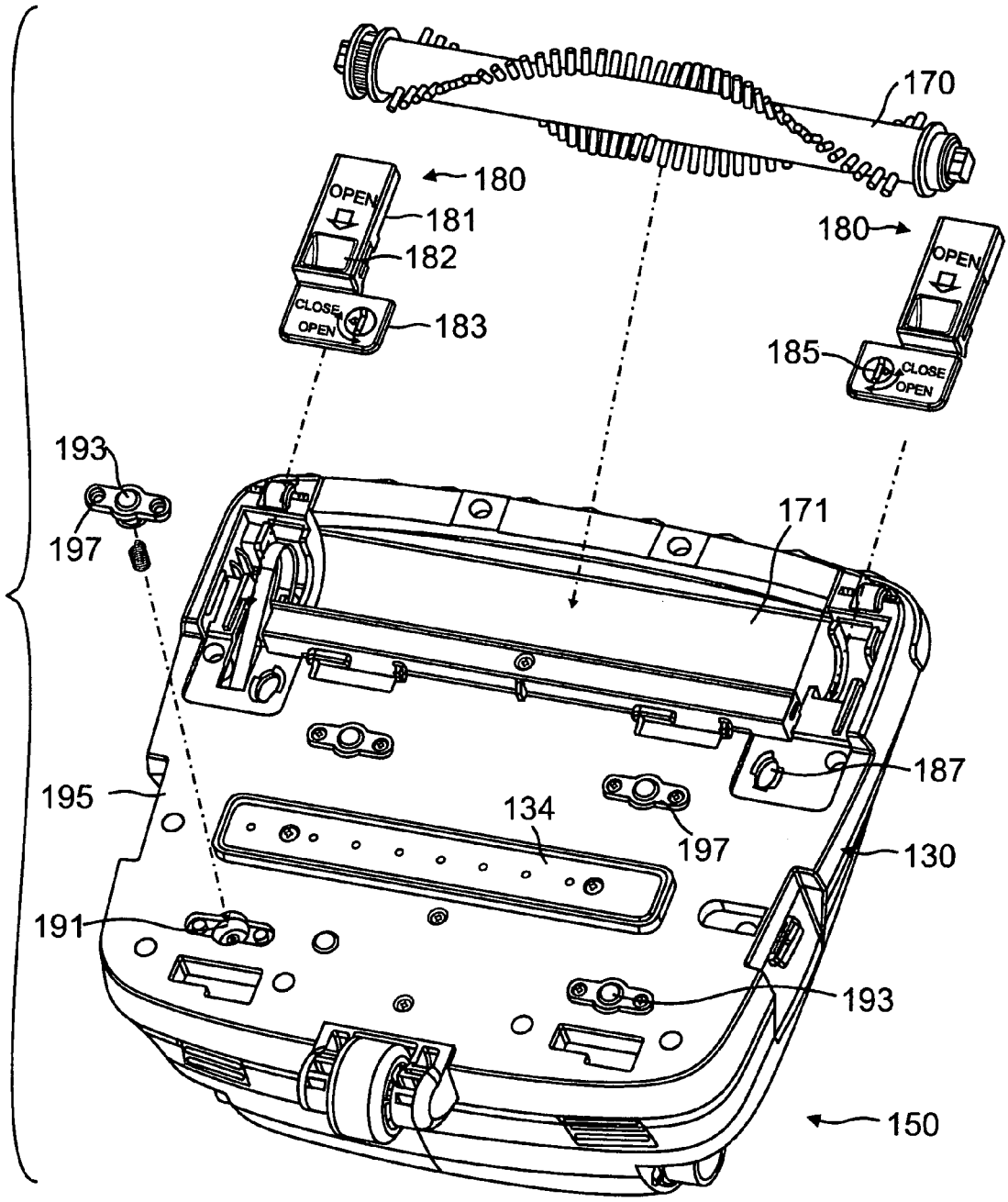
FIG. 6 is an exploded bottom perspective view of an elevating member in FIG. 5.
Figure 7:
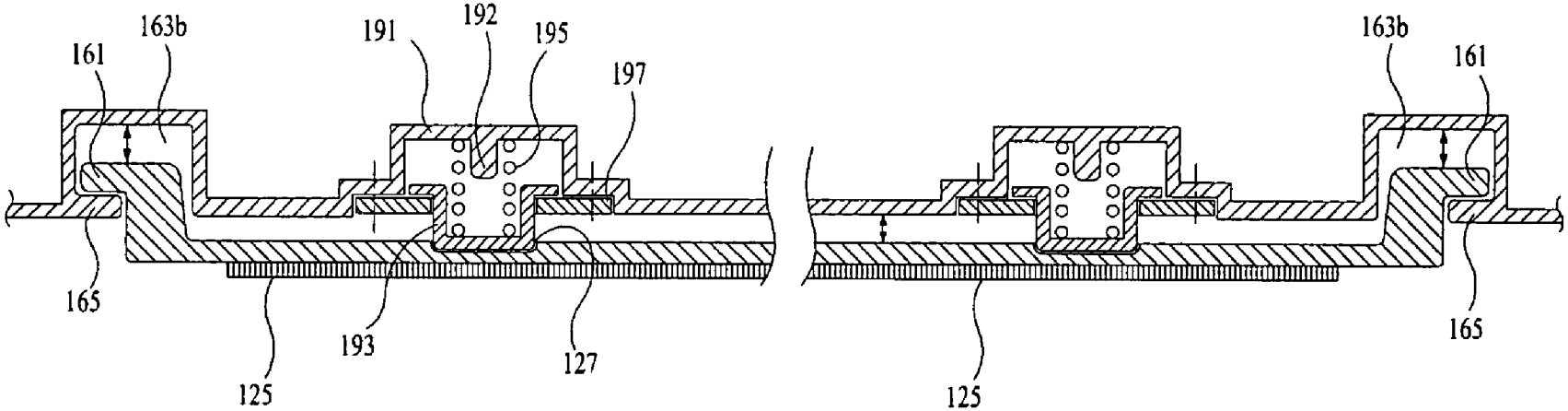
FIG. 7 is a sectional view showing the main portion of the elevating member in FIG. 6.

As shown in FIG. 6 and FIG. 7, the elevation support member is constituted with a guide groove 191 formed in the bottom surface of the lower casing 130, an elevation guide 193 elevating along the guide groove 191, a spring 195 interposed between the guide groove 191 and the elevation guide 193, a fixing piece 197 for fixing the elevation guide 193 to the lower casing 130 to prevent the separation of the elevation guide 193 during its movement, and a connect member connected to the lower casing 130 to prevent the separation of the pad attachment tray 120 during its movement. Reference numeral 192 designates a resilient protrusion 192 that prevents the separation of the spring 195. Needless to say, this resilient protrusion may also be formed on the inner side of the top end of the elevation guide 193.

The elevation guide 193 is a tube with its top end covered, and the top end is inserted into the insertion groove 127 which is preferably formed on the top surface of the pad attachment plate 121 such that skidding, etc., may be avoided and the elevating movement can be done in a stable manner.

Figure 5:
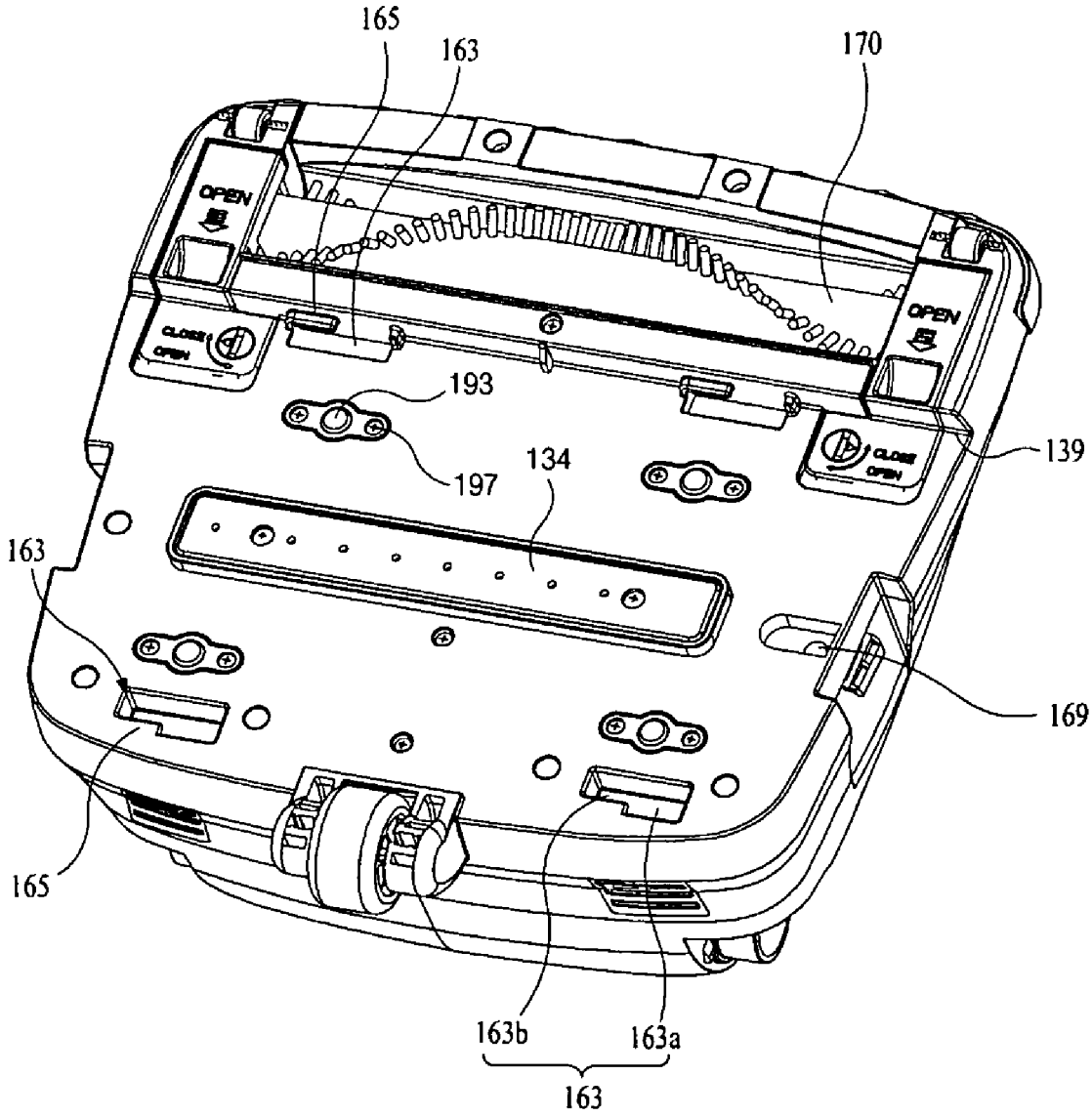
FIG. 5 is a bottom perspective view of FIG. 4 without a pad attachment tray.

As shown in FIG. 1, FIG. 5 and FIG. 7, the connect member is constituted with a connect protrusion 161, an elevation receiving groove 163 to which the connect protrusion 161 is received in an elevatable manner, and a separation prevent bar 165 for preventing the separation of the connect protrusion 161.

That is, the elevation receiving groove 163 is divided into an insertion groove **163*a* to which the connect protrusion 161 is inserted, and an elevation groove 163*b* in which the separation prevent bar 165** is placed.

The connect protrusion 161 is formed, as shown in FIG. 1, on the top surface of the pad attachment plate 121.

The elevation receiving groove 163 and the separation prevent bar 165 may be formed on the bottom surface of the lower casing 130, i.e., on the bottom surface where the elevatable recess 139 is formed (this is the bottom surface when seen from FIG. 6, and the top surface when positioned uprightly).

Therefore, when the connect protrusion 161 is put into the insertion groove 163*a* and pushed aside, the pad attachment tray 120 is stopped by the separation prevent bar 165 and assembled onto the bottom surface of the lower casing 130.

Moreover, pad attachment tray locking sections 167 and 169 are preferably provided to prevent the pad attachment tray 120 from being pushed out on the other side after it has been pushed to one side and assembled thereon.

In terms of the pad attachment tray locking sections 167 and 169, if the screw groove is turned with a coin or the like, a protrusion (not shown) which is formed at the pin 167 is caught and locked by the hooking piece 169 which is formed at the elevatable recess 139, or released therefrom. This locking/release operation is similar to the connection between the lower dust collection bin 210 and the upper dust collection bin 230 (except one difference of turning with a lever or turning with a driver or a coin, etc.).

The lower casing 130 is provided, as shown in FIG. 5 and FIG. 6, with a support cover member 180 which supports and covers both ends of the rotating brush 170.

The support cover member 180 is constituted with a support cover 181 and a support cover locking section 183.

The support cover 181 is connected and supported on the bottom surface on both sides of the bracket 170 of the rotating brush 170, and has a groove 182 that can be lifted up with a finger.

Similar to the pad attachment tray locking sections 167 and 169 described earlier, as for the support cover locking section 183, a protrusion (not shown) which is formed at a pin 185 is either caught and locked by a hooking piece 187, or released therefrom.

Because of the support cover member 180, it is easy to attach or detach the rotating brush 170 and further to replace or clean it.

In addition, it is preferable to arrange the cover tray 140 in a detachable manner at the bottom surface of the pad attachment tray 120.

That is, the cover tray 140 covers the protrusions 125 of the pad attachment tray 120.

In this way, when vacuuming or steam cleaning a product made of wool such as a carpet for example, the protrusions 125 of the pad attachment tray 120 do not get entangled in hairs or the hairs do not come off.

Also, considering that carpets are made of yarns or fibers of different heights, if the carpet is very thick, there is a high possibility that the rotating brush 170 gets stuck in the carpet and does not rotate unless the suction nozzle 131 where the rotating brush 170 is at is increased further with respect to the carpet. To avoid such a problem, it is preferable to place carpet designated wheels 145 on the front side of the cover tray 140. As shown in FIG. 10, wheels 145 are farthest from the rotating brush 170, a rear wheel 138 installed at the lower casing 130 is the next, and then a front wheel 139 installed at the lower casing 130 is closet to the rotating brush 170.

The cover tray 140 is constituted with a cover plate 141 which covers the protrusions 125, a detachable section 142 which supports the cover plate 141 in a detachable manner against the main body 110, and wheels 145 provided to both front sides of the cover plate 141. A long hole 142 is formed at the center of the cover plate 141 to hold the steam distribution duct 134.

Also, referring back to FIG. 1, insertion protrusions 148 are preferably formed at the cover plate 141 to be insertedly fixed to the protrusions 125.

In the presence of these insertion protrusions 148, it becomes possible to prevent a back and forth movement with respect to the cover plate 141. If there is a gap between the front end of the cover plate 141 and the front end of the elevation receiving groove 139, a protruded piece 49 is provided to the front end of the cover plate 141 such that the protruded piece comes in contact with the front end of the elevation receiving groove 139 to ensure there is no back and forth movement due to the gap.

The detachable section 142 is constituted with pivotable hooking pieces which are formed on both sides of the cover plate 141, and a fixed hooking piece 144 which is formed at the upper casing 150. The fixed hooking piece 144 may either be formed in a recessed area of the upper casing 50 as shown in FIG. 1, or be protruded outward of the upper casing 150 as shown in FIG. 8.

Furthermore, the wheels 145 are preferably installed at the cover plate 141 in a detachable manner by means of an intermediate member 146.

This intermediate member 146 is constituted with a vertical portion 146*a* and an insertion portion 146*a* which has a '⊂' shape protruded from one side of the vertical portion 146*a*.

The vertical portion 146*a* is screwed to the wheels 145, and the insertion portion 146*b* is inserted with a screw into one side of the cover plate 141.

In particular, rugged portions 146*c* are formed on the cover plate 141 and the insertion portion 146*b* to ensure that the wheels 145 do not come off when moving.

Since the wheels 145 can be detached, it is possible to replace wheels with suitable ones depending on the thickness of the carpet.

Now referring to FIGS. 12-15, the dust collector 200 is constituted with lower and upper dust collection bins 210 and 230 detachably installed at the dust collector mounting groove 153, and a packing 240 provided to the outer circumferential surface of the lower dust collection bin 210.

The intake port 211 which is connected with the intake duct 173 is formed at the front surface of the lower dust collection bin 210, and the exhaust port 213 where a filter 250 is mounted is formed at the rear surface of the upper dust collection bin 230.

A door 212 is preferably installed at the intake port 211. This door 212 opens by the force of intake air, and is closed by gravity after the force disappears.

The door 212 with this structure enables to block dust, etc., escaping from the intake port 211 when the cleaner is not in use.

The filter 250 is largely divided into a first filter 251 and a second filter 256.

The first filter 251 is a screen type filter which is installed inside the upper dust collection bin 230 to primarily filter somewhat coarse dust, and the second filter 256 filters micro dust that has not been filtered off by the first filter 251.

The first filter 251 has a box shape with a screen formed at the front surface 251*a* and the bottom surface 251, and has a bore 252 on the rear surface 251*c* to let the second filter 256 in through it. Thus, since the second filter 251 passes through the bore 252 and is located within the first filter 251, it occupies a substantially small area and creates a broader space for dust collection.

In addition, the lower surface 251*b* is detachably connected to the front surface 251*a*. On the top surface of a blocking plate 260 (to be described) is a triangular base protrusion 262 which supports the bottom surface 251*b*. When the lower dust collection bin 210 and the upper dust collection bin 230 are connected to each other, the base protrusion 262 supports the bottom surface 251*b* so the lower surface 251*b* is strongly restricted from going off.

The second filter 256 has a cylindrical shape and is arranged inside the first filter 251 that is mounted at the exhaust port 213. Accordingly, the exhaust port 213 serves as a filter mount hole 213 of the second filter 256 to let the air that has passed through the second filter 256 flow towards the intake port 833 of the intake motor 800.

As shown in FIG. 10, the packing 240 seals and presses the inner circumferential surface of the upper dust collection bin 230 when the upper dust collection bin 230 and the lower dust collection bin 210 are connected.

In this way, the upper dust collection bin 230 can be separated gently without letting dust or moisture accumulated therein escape outside, which resultantly makes it easy to handle the bin itself.

Particularly, the upper dust collection bin 230 is a main dust collection bin and is located over the lower dust collection bin 210, so it serves as a cover during cleaning. Meanwhile, the lower dust collection bin 210 is an auxiliary dust collection bin and is located under the upper dust collection bin 230, so it serves as the bottom of the upper dust collection bin during cleaning. On the contrary, when the dust collector 200 is being dust off, it is turned over and serves as a cover to place the lower dust collection bin 210 thereon and open it, while the upper dust collection bin 230 serves as the main dust collection bin. Preferably, the upper dust collection bin 230 which serves as the main dust collection bin has a see-through window 235 to allow a user to be able to take a peek inside.

As explained above, the upper dust collection bin 230 and the lower dust collection bin 210 function differently depending on their use, so it is desirable to provide the packing 240 to separate the bins gently.

The packing 240 is preferably mounted in a groove which is formed at the outer circumferential surface of the lower dust collection bin 210.

Since the upper dust collection bin 230 is supported on the lower dust collection bin 210 by means of the packing 240, and the lower dust collection bin 210 is mounted inside the dust collector mounting groove 153, one cannot see it from outside. Therefore, it is preferable to form lift grooves 237 on both sides of the upper dust collection bin 230 to make it easier to take the dust collector out for cleaning or the like. These lift grooves 237 are about the size of a finger to pass through and has an "inverted ⊓" shape on the top end of each.

Moreover, a locking member 220 is preferably installed in order to lock the upper dust collection bin 230 and the lower dust collection bin 210.

Since the locking member 220 is interconnected only by the packing 240, it ensures that the lower dust collection bin 210 does not come off when being taken out through the lift grooves 237. The locking member 220 is constituted with a hooking bar 221 which is formed at the inner circumferential surface of the upper dust collection bin 230 and on which the top end of the lower dust collection bin 210 is caught, and a locking section 223 which is formed at the lower dust collection bin 210 to be locked onto the hooking bar 221.

Figure 17:
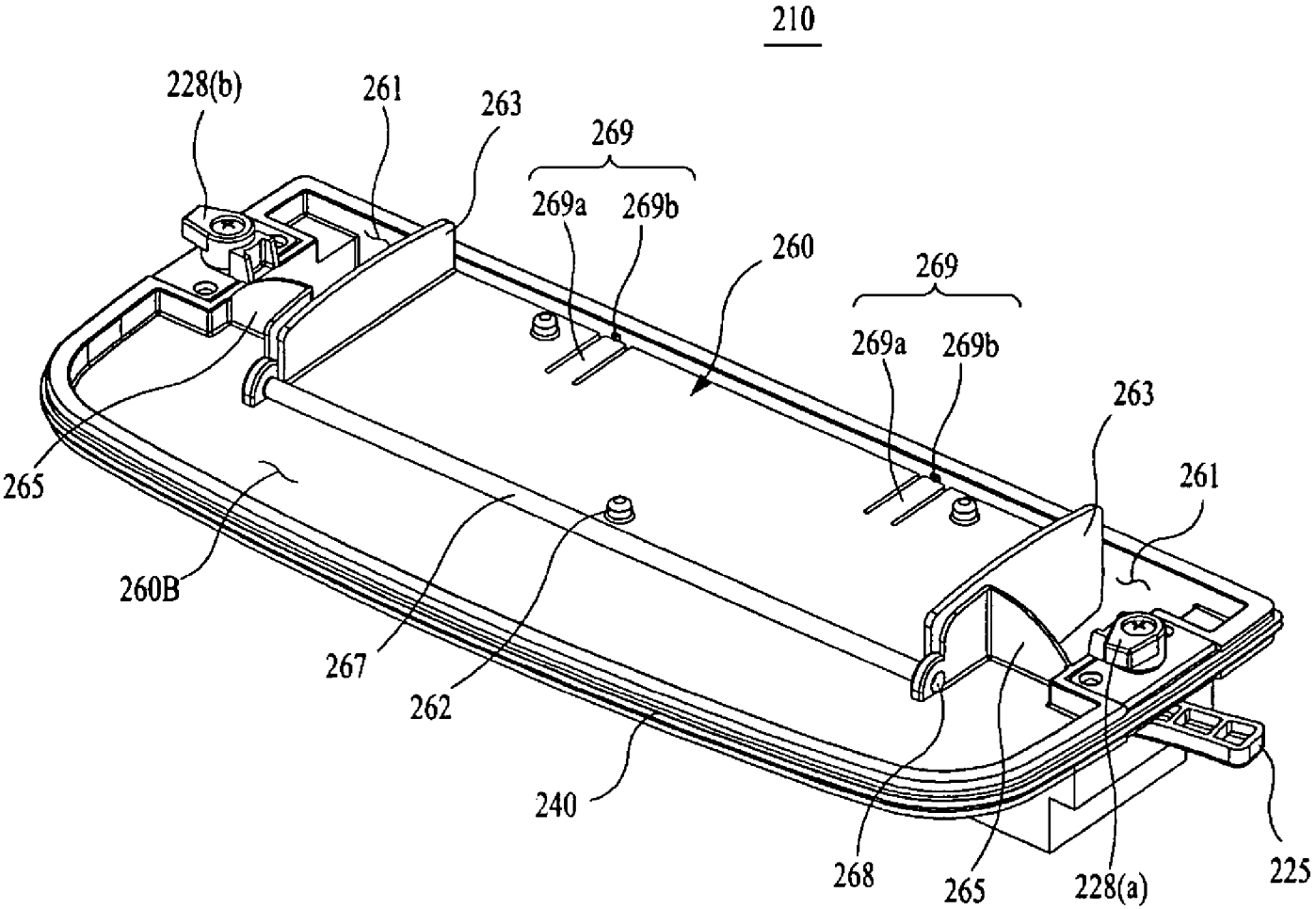
FIG. 17 is a front perspective views of a blocking plate of a lower dust bin in use.
Figure 19:
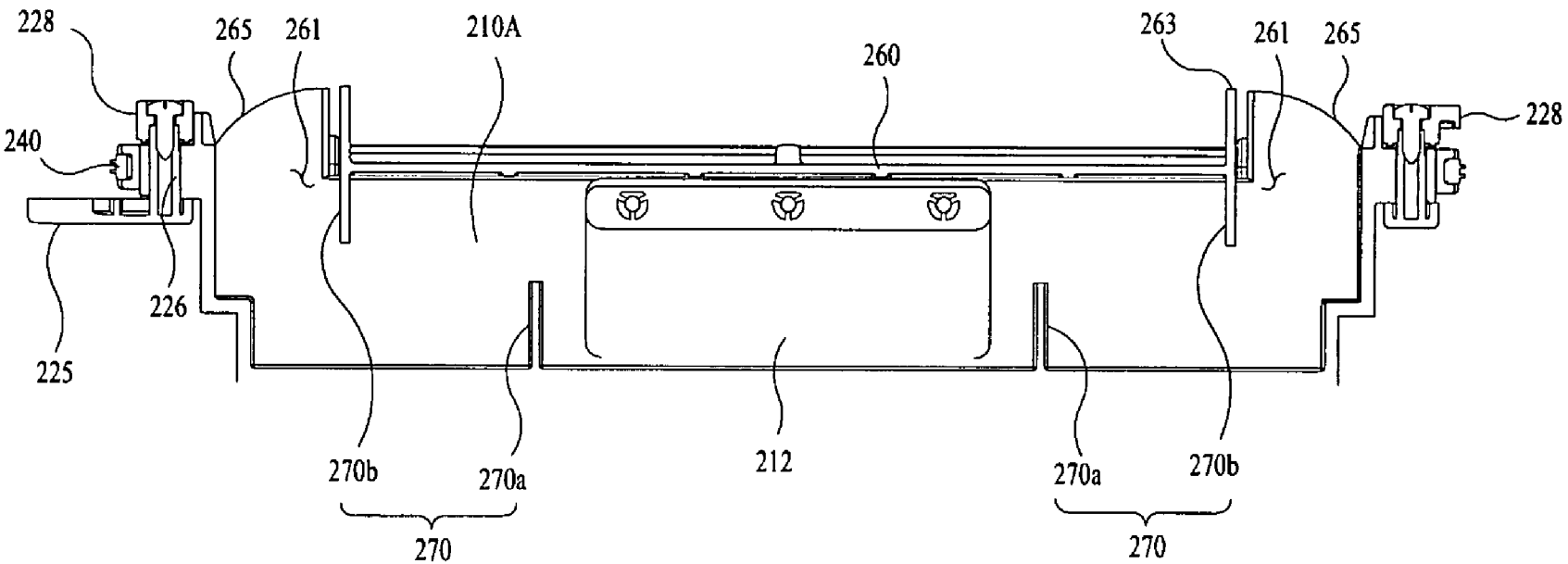
FIG. 19 is a horizontal sectional view of FIG. 18.

As shown in FIG. 17 and FIG. 19, the locking section 223 is constituted with a shaft 226 which is installed at the lower dust collection bin 210, and a lever 225 and a locking piece 228 which are installed at the lower and upper ends of the shaft 226.

As shown in FIG. 17, reference numeral 228(*a*) indicates that the locking piece 228 is being released, and reference numeral 228(*b*) indicates that the locking piece 228 is being locked on the hooking bar 221.

In particular, the hooking bar 221 serves as a stopper that determines a connection position of the upper and lower dust collection bins 230 and 210 by preventing deeper insertion when they are connected.

Also, the blocking plate 260 is preferably installed at the lower dust collection bin 210 to block part of the top surface of a lower dust collection chamber.

A first lower dust collection chamber 210A that communicates with the intake port 211 is formed on one side of the lower dust collection chamber, and a second lower dust collection chamber 210B is formed on the other side of the lower dust collection chamber.

The first lower dust collection chamber 210A is substantially deeper than the second lower dust collection chamber 210B. Because of this configuration, the first lower dust collection chamber 210A essentially serves only as an air flow passage 261*a* and as a dust collection chamber where a little dust is accumulated, while the second lower dust collection chamber 210B serves as a bottom plate of the upper dust collection bin 230 which relatively functions as the main dust collection bin.

Therefore, the blocking plate 260 prevents foreign substances from being accumulated in the first lower dust collection chamber 210A to therefore increase the dust suction efficiency.

In addition, it is dynamically preferable to install the blocking plate 260 at the center so that the air flow passages 261 are formed on both sides. Since the air that is intaken through the intake port 211 is pushed up to the upper dust collection bin 230 at ½ pressure in the air flow passages 261, it is gathered on the blocking plate 260 and the second lower dust collection chamber 260B as much as possible.

Furthermore, a partition 270 is preferably formed at the first lower dust collection chamber 260A.

That is, the partition 270 inhibits dust having been accumulated the air flow passages 261*a* from reentering the first lower dust collection chamber 260 as much as it can.

The partition 270 is embodied as a first partition 270*a* which is formed at the bottom of the first lower dust collection chamber 260A, and a second partition 270*b* which is formed at the bottom surface of the blocking plate 260.

Figure 18:
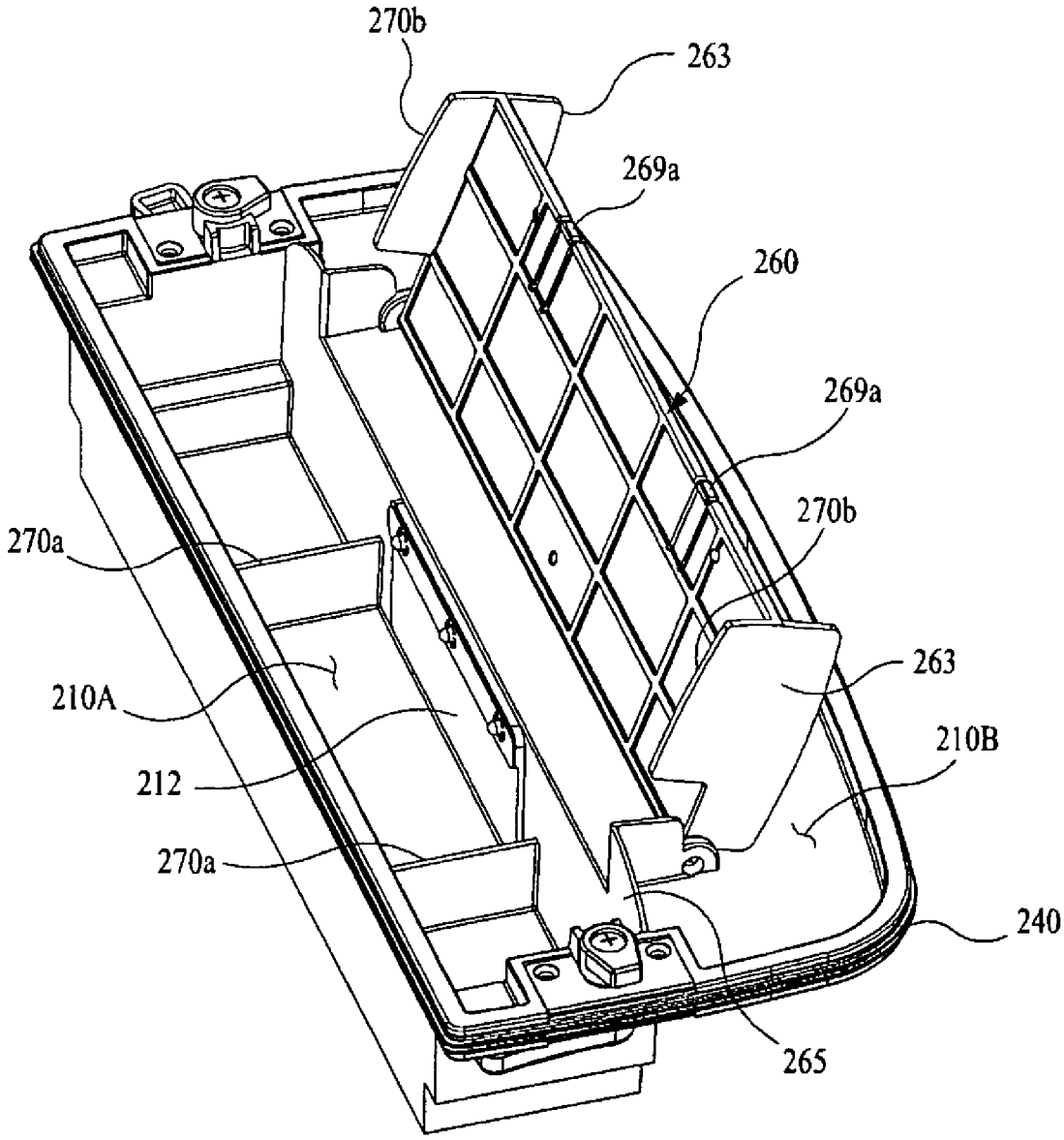
FIG. 18 is a front perspective views of a blocking plate of a lower dust bin in use.

As shown in FIG. 18, the first partition 270*a* is preferably formed either side with respect to the intake port 211, and the second partition 270*b* is preferably formed on the bottom surface of either end of the blocking plate 260.

Also, the first partitions 270*a* and the second partitions 270*b* are preferably in zigzag form to suppress the reverse flow as much as possible and at the same time to secure the intake air flow passage as much as possible.

Moreover, blocking wings 263 are further formed on the top surface of both ends of the blocking plate 260 such that the dust having been accumulated on the blocking plate 260 may not fall towards the air flow passages 261.

The 'L' shape blocking wall 265 is also provided at the boundary between the blocking wings 263*a* and the air flow passages 261, as a result of which dust that has been accumulated in the second lower dust collection chamber may not fall towards the air flow passages 261. The blocking plate 260 is pivotably supported by a hinge shaft 267.

The hinge shaft 267 is formed in a hinge hole 268 that is formed at the blocking wall 265. Preferably, the blocking plate 260 is locked onto the lower dust collection bin 210 by means of the locking section 269. In doing so, when it is disassembled to get rid of dust, the blocking plate 260 may not be pivoted arbitrarily to let the dust fall.

The locking section 269 is constituted with a locking bar 269*b* which is formed at the inner wall of the first lower dust collection chamber 260A, and a locking protrusion 269*a* which is formed at the blocking plate 260 to be caught on the locking bar 269*b*. The locking bar 269*a* is embodied as a cantilever at the blocking plate 260 to give more elasticity overall when being locked or released than being caught on or released from the locking bar 269*b*, consequently preventing damages on the blocking plate 260 by easily locking or releasing it.

Accordingly, since the lower dust collection bin 210 is constituted with the first lower dust collection chamber 210A having a greater depth and the second lower dust collection chamber 210 having a relatively smaller depth, the front-to-back length of the main body 110 can fully be used as in the prior art by the installation length of the rotating brush 170.

In other words, as the first lower dust collection chamber 210A is mounted deeper at the dust collector mounting groove 153 and the second lower dust collection chamber 210B is mounted simply to be laid across the dust collector mounting groove 153, it only occupies ½ less than the dust collector mounting groove of the existing dust collector which does not use a rotating brush.

Accordingly, the dust collector mounting groove 153 saves space as much as the space occupied by the rotating brush 170, there is no need to extend the total length of the main body 110. Also, because the upper dust collection bin 230 replaces the saved space to gather dust, it becomes possible to maintain the main body 110 to the same size and to improve carpet cleaning and dust suction force that are advantages of the rotating brush.

As described above, when mounted in the main body 110 (to get ready for cleaning the floor), the upper dust collection bin 230 is used as the main dust collection bin and the lower dust collection bin 210 is used as the auxiliary dust collection bin, such that the blocking plate 260 prevents the dust from being accumulated in the lower dust collection bin 210. When detached from the main body 110 (to get rid of the accumulated dust), the blocking plate 260 makes sure that the dust having been accumulated in the first lower dust collection chamber 210A of the lower dust collection bin 210 does not fall down abruptly when the user opens up the lower dust collection bin 210.

As shown in FIG. 6 and FIGS. 20-22, the motor assembly 800 is constituted with an intake motor 810, an impeller casing 830, and a motor cooling casing 850.

The intake motor 810 is constituted with a motor drive section 811 having a cooling fan, and an impeller 813 that receives the power from the motor drive section 811. This motor 810 is mounted in the motor mounting groove 157.

The impeller 813 is designed to intake air in the rotation central axis direction and to exhaust it in the circumferential direction, to inhibit any invasion of moisture or the like of the motor drive unit 811.

The impeller casing 830 is constituted with a circumferential casing 831 for encompassing the impeller, an intake casing 833 that fits into the first bore 154, and an exhaust port 835 that is formed in the circumferential casing 831.

One end of the turbine wing 710 is rotatably supported on the exhaust port 835.

In other words, the exhaust port 835 of the intake casing 833 serves as a shaft of the turbine wing 710, injecting exhaust wind directly to the turbine wing 710 and turning them. Thus, it becomes possible to support the turbine wing 710 even within the narrow space and to ensure there is no loss in the exhaust wind through this compact construction.

The rotational force of the turbine wing 710 is delivered by the rotation power transmit member 400 to be used to rotate the rotating brush 170.

Therefore, unlike the prior art, the rotating brush 170 used for improving the carpet cleaning and suction force is rotated by wind that is directly injected from the intake motor 800, so there is no loss in the exhaust wind and the suction force can be improved with the small-sized motor. For instance, it is possible to get 1000 W effects out of 700 W motor (due to the improved suction force in result of the rotation of the rotating brush).

Referring to FIGS. 22-26, the rotation power transmit member 400 is constituted with a drive shaft 410 which receives the rotational force of the other end of the turbine wing 710, and a belt 430 which transmits the torque of the drive shaft to the rotating brush 170.

One end 411 of the drive shaft 410 is a serration (or spline axis) that is inserted and fixed to a boss (or spline) 711 of the turbine wing 710, and on the other end of the drive shaft 410 is a chamfer of a woodruff key shape, to which a drive pulley 431 is inserted and fixed. The belt 430 is laid across the drive pulley 431 and the driven pulley 433 of the rotating brush 170. Among many belts, the belt 430 is preferably a timing belt excellent in rotation transmission. In case of the timing belt, both the drive belt 431 and the driven pulley 433 have a tooth shape.

One end 411 of the drive shaft 410 supports the other end of the turbine wing 710, and the other end of the drive shaft 410 is supported by a mounting portion 440.

The mounting portion 440 is constituted with a shaft support mounting portion 450 which supports the other end of the drive shaft 410 to be rotatable, and a fixed mounting portion 470 which fixes the shaft support mounting portion 450 to the upper casing 150.

The shaft support mounting portion 450 is constituted with a first bearing and a second bearing 453 which support the other end of the drive shaft 410, and a bearing support bracket 460 which is fixed to the fixed mounting portion 470 while supporting the first and second bearings 451 and 453.

The bearing support bracket 460 is constituted with a first leg plate 462 having a first paddle support hole 461 that supports the paddle of the first bearing 451, a second leg plate 464 having a second paddle support hole 463 that supports the paddle of the second bearing 453, and a connection plate 466 that provides a connection function to form an opening 465 between the first leg plate 462 and the second leg plate 464. This bearing support bracket 460 may be formed in one unit by the pressing process.

Fastening holes 467 are formed in the front and rear sides of the connection plate 466 to fix the plate to the fixed mounting portion 470 by pieces, etc.

Preferably, a spacer 468 is installed at the connection plate 466 to be arranged between the first bearing 451 and the second bearing 453.

This spacer 468 stops the first bearing 451 and the second bearing 453 approaching each other.

An easier way to get the spacer 468 is to make it in a bent plate form which is obtained by punching the connection plate 466 in the shape of '⊂'. Accordingly, a bore 469 is formed at the area where the spacer 468 is punched and bent.

In addition, C shape rings 452 and 453 are preferably inserted into fastening grooves 451 and 416 to prevent the first bearing 451 and the second bearing 453 from getting more distant from each other.

The structure of the bearing support bearing 460 described above is a very advantageous structure in that a minimal space for 2-point support with two bearings is ensured on the other side, not both sides, of the drive shaft 410, and that the stable and sure rotation can be performed.

Figure 29:
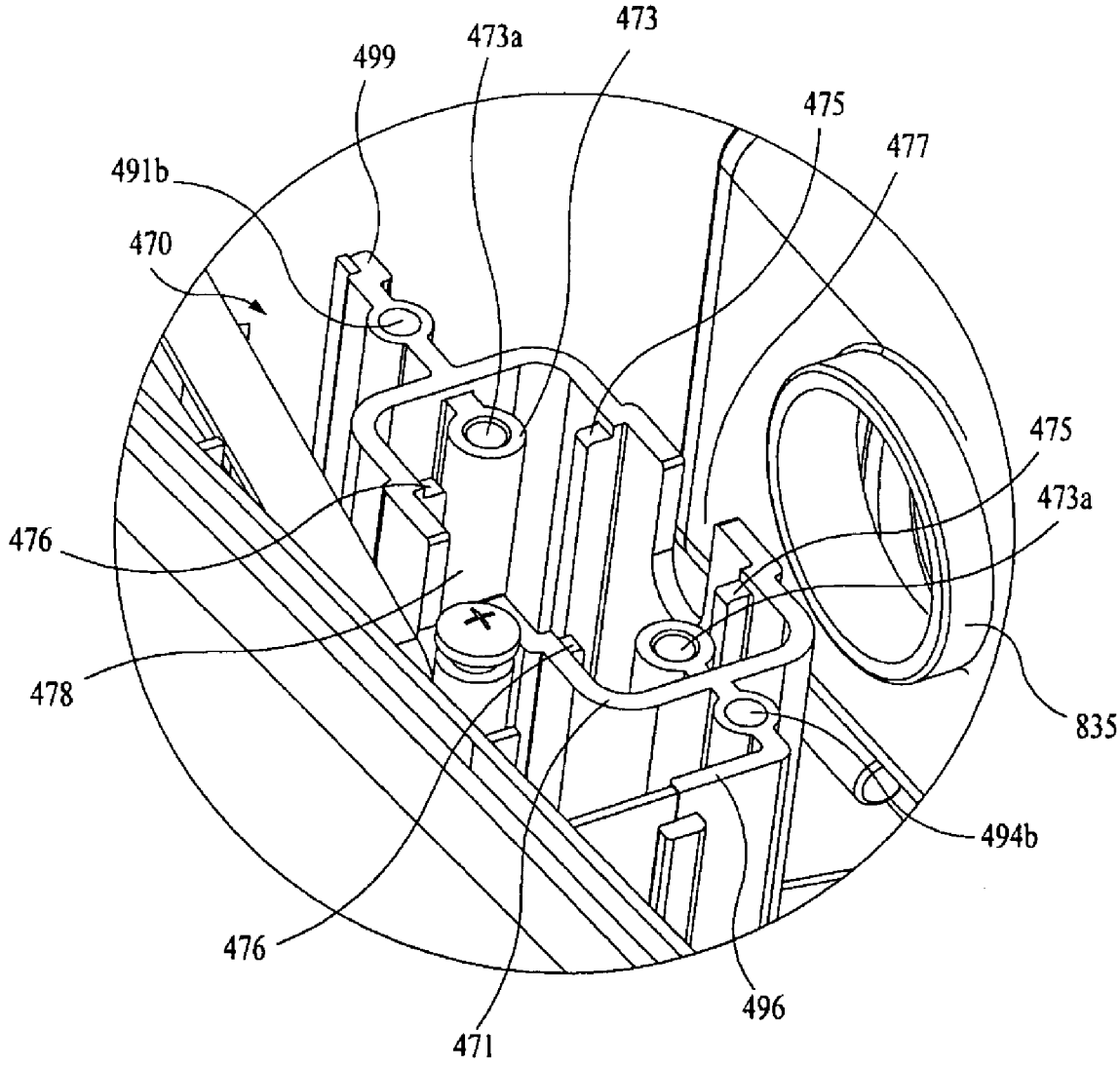
FIG. 29 is an enlarged perspective view of a fixing mount portion.

Referring to FIG. 29, the fixed mounting portion 470 is constituted with a mounting wall frame 471 for encompassing the outside the bearing support bracket 460, fastening frames 473 that are formed on the front and rear sides of the mounting wall frame 471 to hold the connection plate 466, and receiving grooves 477 and 478 that are formed on both sides of the mounting wall frame 471 to receive the drive shaft 410.

Also, guide bars 475 and 476 for guiding the leg plates 462 and 464 are provided in front and back of the receiving grooves 477 and 478.

Therefore, when the leg plates 462 and 464 of the bearing support bracket 460 are inserted into the guide bars 475 and 476 and put underneath, the connection plate 466 is caught on the fastening frame 473 and stopped. Then, the connection plate 466 is fixed by placing pieces, etc., into the fastening holes 467 and 473*a*.

Since a space is needed at the bottom surface of the upper casing 150 to install the rotation power transmit member 400, the motor mounting groove 157 and the rotating brush casing 171 create a communicating space between them.

The motor running noise or the exhaust wind may escape through the space to the suction nozzle 131. To avoid this, a barrier 490 is preferably installed at the fixed mounting portion 470.

Barrier fixing ribs 499 and 496 are formed on the front and rear parts of the outside of the mounting wall frame 471 of the fixed mounting portion 470 to allow the barrier 490 to be inserted and fixed therein.

Insertion grooves 491*b* and 494*b* are molded into the top surface of the barrier fixing ribs 499 and 496.

Insertion protrusions 491*a* and 494*b* to be inserted into the insertion grooves 491*b* and 494*b* are formed at the bottom surface of the barrier 490.

Fit protrusions 492 and 493 are formed on the front side of the bottom surface of the barrier 490 to receive the barrier fixing rib 499, and fit protrusions 495 and 497 are formed on the rear side of the bottom surface of the barrier 490 to receive the barrier fixing rib 496.

Moreover, a clog 498 is provided to the center of the bottom surface of the barrier 470 to cover the bore 469 of the connection plate 466.

Preferably, a motor cooling casing 850 is further installed at the motor drive section 810. As shown in FIG. 20, on the circumferential surface of the motor cooling casing 850 is a cooling air intake port 853 which is connected to the first vent hole 158, and a cooling air exhaust port 855 which is connected to the second vent hole 159.

That is, when the cooling fan 815 of the motor drive section 810 rotates, outside air is sucked into the first vent hole 158 and the cooling air intake port 853. This outside intake air is discharged to outside through the cooling air exhaust port 855 and the second vent hole 159.

With the cooling flow of the motor drive section 810, although the size of the motor 810 may be reduced, the efficiency is higher enough to do suction at a required capacity.

Referring to FIG. 10, a flow separation packing 860 is preferably installed between the motor drive section 810 and the motor cooling casing 850.

In so doing, when cool air from outside is introduced into the motor cooling casing 850, the air flows to the inside of the motor drive section 810. Then warm air having circulated the inside of the motor drive section 810 comes out to the outer circumferential surface of the motor drive section 810 and is discharged through the cooling air exhaust port 855, as a result of which the intake air and the discharged air do not meet each other and the cooling efficiency is increased even more.

The motor cooling casing 850 is preferably made of see-through materials to permit the user to take a look at the assembly state of the flow separation packing 860.

The turbine wing 710 is directly connected to the exhaust port 835 to get immediate injection.

Therefore, the exhaust wind going out of the exhaust port 835 is controlled by an exhaust wind controller 870 to adjust the amount of turn of the rotating brush 170. For example, depending on the type of carpet to be cleaned, if the rotating brush 170 has hard bristles, its rotational speed can be controlled to about 2000 rpm; if the rotating brush has soft and flexible bristles, its rotational speed can be controlled to about 300-500 rpm.

Referring to FIG. 30 and FIG. 31, the exhaust wind controller 870 is constituted with a bore 871 formed in the circumferential casing 831, an opening/closing plate 873 for opening/closing the bore 871, and an operational button 875 for operating the opening/closing plate 873. The opening/closing plate 873 is slidably installed at the upper casing 150.

Therefore, when the bore 871 is completely covered with the opening/closing plate 873, the exhaust wind goes out only to the exhaust port 835, and depending on the degree of openness of the bore 871, the strength of the wind towards the exhaust port 835 gets gradually weaker, slowing down the rotation accordingly.

The main assembly (not shown) is constituted with a housing divided into a front mounting casing (not shown) and a rear mounting casing (not shown) that together establish the external shape as in the prior art, and a steam generation section (not shown) loaded on the housing (not shown). Steam that is generated by the steam generation section is ejected through the steam ejection hole 133.

The base assembly for vacuum cleaner according to the present invention is not limited to the aforementioned embodiments, but can be modified in a variety of forms without departing from the spirit and scope of the invention.

The present invention can be applied to a vacuum cleaner having an intake motor provided to the base assembly to make use of exhaust wind.

It is to be understood that other embodiments may be utilized and structural and functional changes me be made without departing from the scope of the present invention. The foregoing descriptions of the embodiments of the invention have been presented for the purposes of illustration and description. It is not intended to be exhaustive or to limit the invention to the precise forms disclosed. Accordingly, many modifications and variations are possible in light of the above teachings. It is therefore intended that the scope of the invention not be limited by this detailed description.

The invention claimed is:

1. A base assembly for a vacuum assembly, comprising:

a dust collector provided with an inlet and an outlet;

an intake motor assembly provided with an intake port and an exhaust port that are connected to the outlet;

a main body comprising an upper casing provided with a dust collector mounting groove for the dust collector and a motor mounting groove for the intake motor assembly, and a lower casing provided with a suction nozzle facing a bottom;

a rotating brush arranged over the suction nozzle and installed rotatably at the main body;

a turbine wing that rotates by wind exhausting through the exhaust port; and a rotation power transmit member for transmitting rotating force of the turbine wing to the rotating brush.

2. The base assembly for a vacuum cleaner as set forth in claim 1, wherein the intake motor assembly further comprises:

a motor having a motor drive section and an impeller that receives power of the motor drive section in a shaft direction being transmitted and discharges it in a circumferential direction;

an impeller casing having the intake port and the exhaust port; and an exhaust wind controller for controlling wind that exhausts through the exhaust port.

3. The base assembly for a vacuum cleaner as set forth in claim 1 or claim 2, wherein one end of the turbine wing is rotatably supported on the exhaust port, and the other end is supported on the rotation power transmit member.

4. The base assembly for a vacuum cleaner as set forth in claim 3, wherein the rotation power transmit member comprises a drive shaft that receives rotating force from an other end of the turbine wing, and a belt that transmits the torque of the drive shaft to the rotating brush, one end of the drive shaft supporting the other end of the turbine wing, the other end of the drive shaft being supported by a mounting portion which comprises a shaft support mount portion for supporting the rotation of the other end of the drive shaft, and a fixing mount portion for fixing the shaft support mount portion to the upper casing.

5. The base assembly for a vacuum cleaner as set forth in claim 4, wherein the shaft support mount portion comprises first and second bearings for supporting the other end of the drive shaft, and a bearing support bracket fixed to the fixing mount portion while supporting the first and second bearings, wherein the bearing support bracket includes a first leg plate and a second leg plate having a first paddle wheel support ball and a second paddle wheel support formed thereon to support the first bearing and the second bearing, respectively, and a connecting plate which connects the first leg plate and the second leg plate in a way that an opening is formed between them and which is fixed to the fixing mount portion.

6. The base assembly for a vacuum cleaner as set forth in claim 5, wherein the connecting plate is provided with a spacer that is arranged between the first bearing and the second bearing.

* * * * *